US006109708A

United States Patent [19]

Walla et al.

[11] Patent Number: 6,109,708

[45] Date of Patent: Aug. 29, 2000

[54] LOCKING MECHANISM FOR DRAWER SYSTEM

[75] Inventors: Gregg Walla, Lake Bluff; E. Grant Swick, Bartlett; William E. Ruehl, Elgin, all of Ill.

[73] Assignee: Timberline Lock Ltd., Lake Bluff, Ill.

[21] Appl. No.: 09/197,901

[22] Filed: Nov. 23, 1998

[51] Int. Cl.[7] ..... E05C 7/06

[52] U.S. Cl. ..... 312/216; 312/221

[58] Field of Search ..... 312/215, 216, 312/217, 218, 219, 220, 221, 222, 107.5

[56] References Cited

U.S. PATENT DOCUMENTS

| | | | |
|---|---|---|---|
| 3,199,937 | 8/1965 | Mitchell | 312/221 |
| 3,259,444 | 7/1966 | Friend | 312/221 |
| 3,454,320 | 7/1969 | Orlree | 312/217 |
| 3,881,792 | 5/1975 | Orain | 384/276 |
| 4,298,236 | 11/1981 | Laroche | 312/217 X |
| 4,429,930 | 2/1984 | Blouin | 312/216 |
| 4,441,767 | 4/1984 | Stark | 312/216 |
| 4,609,233 | 9/1986 | Walla | 312/219 |
| 4,705,326 | 11/1987 | Craig | 312/221 |
| 4,711,505 | 12/1987 | Lakso | 312/220 |
| 4,925,257 | 5/1990 | Frederiksen et al. | 312/221 |
| 4,955,672 | 9/1990 | Pham | 312/107.5 |
| 5,056,876 | 10/1991 | Scheerhorn | 312/221 |
| 5,176,436 | 1/1993 | Mitchell | 312/221 |
| 5,303,994 | 4/1994 | Elsholz | 312/221 |
| 5,333,949 | 8/1994 | McGregor | 312/221 |
| 5,335,986 | 8/1994 | Hartrum et al. | 312/220 |
| 5,586,817 | 12/1996 | Hubbard et al. | 312/222 X |
| 5,599,078 | 2/1997 | Dechene et al. | 312/221 |
| 5,634,701 | 6/1997 | Hendrich et al. | 312/221 |

*Primary Examiner*—Peter M. Cuomo
*Assistant Examiner*—James O. Hansen
*Attorney, Agent, or Firm*—Wood, Phillips, VanSanten, Clark & Mortimer

[57] ABSTRACT

A drawer system is provided having a frame, first and second drawers that are each slidable guidingly on the frame between open and closed positions, and a locking mechanism. The locking mechanism has a first blocking element mounted for movement relative to the frame between a blocking position and a neutral position and a second blocking element mounted for movement relative to the frame between a blocking position and a neutral position. A first actuating surface is provided on the first drawer, with a second actuating surface being provided on the second drawer. The first blocking element in its blocking position prevents the second blocking element from moving from its neutral position into its blocking position. The second blocking element in its blocking position prevents the first blocking element from moving from its neutral position into its blocking position. The first actuating surface moves the first blocking element from its neutral position into its blocking position as an incident of the first drawer moving from its closed position into its open position. The second actuating surface moves the second blocking element from its neutral position into its blocking position as an incident of the second drawer moving from its closed position into its open position.

44 Claims, 10 Drawing Sheets

Fig. 7
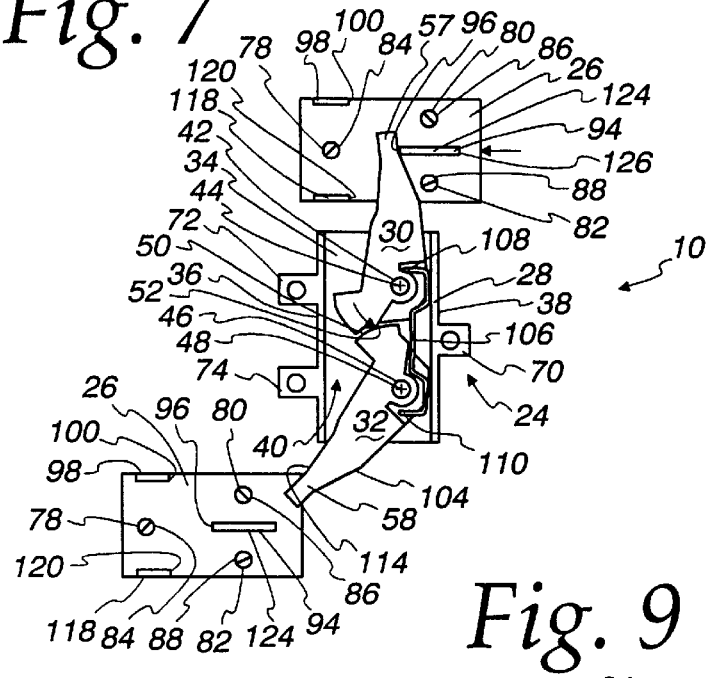
Fig. 8
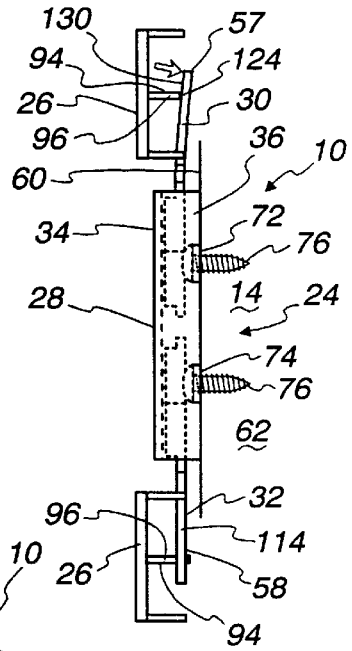
Fig. 9
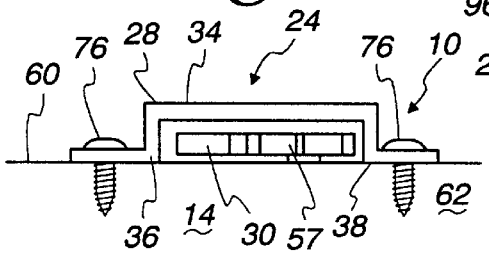
Fig. 11
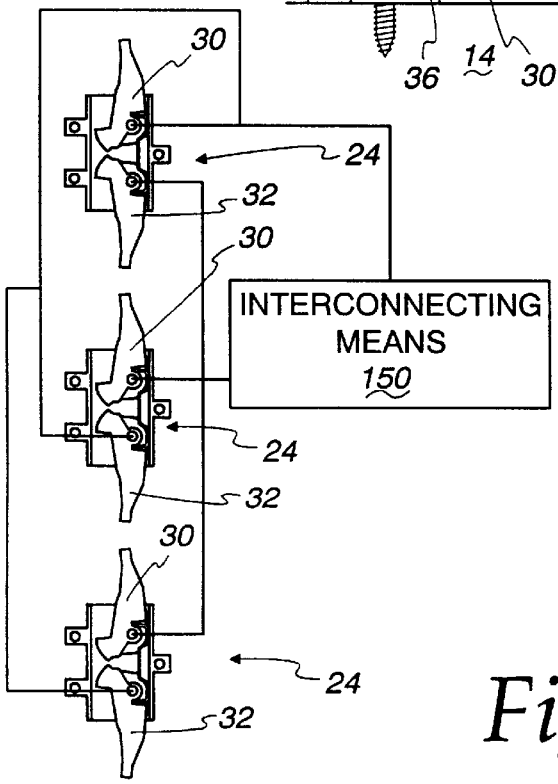
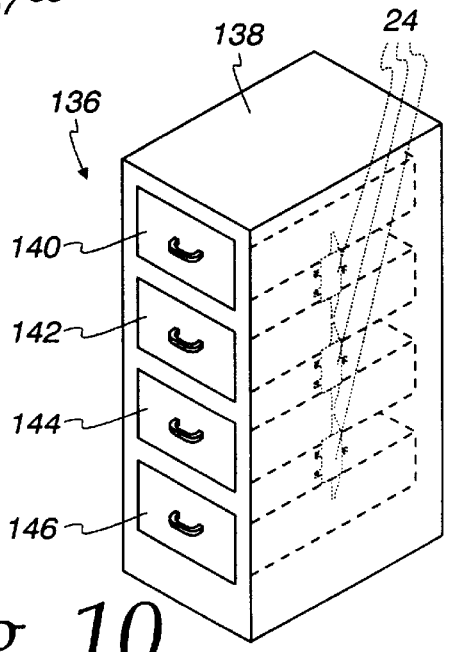
Fig. 10

LOCKING MECHANISM FOR DRAWER SYSTEM

BACKGROUND OF THE INVENTION

1. Field of the Invention

This invention relates to furniture of the type having at least first and second movable drawers and, more particularly, to a locking mechanism that prevents simultaneous movement of the first and second drawers from a closed state into an open state.

2. Background Art

Many furniture systems, such as filing cabinets, have drawers stacked in a vertical column. Depending upon the distribution of the contents of the drawers, simultaneous opening of the drawers could cause the entire cabinet to tip. This condition may occur not only when a user intentionally withdraws multiple drawers, but may occur during an earthquake or when a cabinet is inadvertently tipped, as during transportation or relocation thereof.

To alleviate this problem, a number of locking mechanisms have been devised which are activated upon the opening of one drawer and prevent the withdrawal/opening of one or more additional drawers simultaneously with the one drawer.

One such system uses a slide bar that is guided in vertical movement relative to a frame within which the drawers are mounted. The slide bar has cantilevered pins which project into the path of an actuator on each drawer. The drawers will open only with the slide bar in a first vertical position. By opening one of the drawers, the slide bar is shifted by the actuator on the opening drawer vertically from the first vertical position into a second vertical position to block the remaining drawers from opening. Two examples of this type of system are disclosed in U.S. Pat. No. 4,609,233 (Walla) and U.S. Pat. No. 4,925,257 (Frederiksen et al.).

While the above type of system operates effectively, it has a number of drawbacks. First of all, the actuators on the drawers and the slide bars may need to be manufactured and assembled to within relatively close tolerances. Otherwise, the parts could jam, which could result in the locking system malfunctioning and/or the drawers being obstructed from moving smoothly, or prevented from moving at all.

Another problem with the above type of systems is that the lock bar is commonly mounted in a recessed guide track in the furniture frame. As a result, formation of the track introduces another step in the manufacture of the frame, which potentially adds significantly to manufacturing cost. Precise formation and location of the guide track may be required.

The following patents show different types of locking mechanisms: Mitchell, U.S. Pat. No. 3,199,937; Friend, U.S. Pat. No. 3,259,444; Olree, U.S. Pat. No. 3,454,320; Anderson, U.S. Pat. No. 3,881,792; Blouin, U.S. Pat. No. 4,429,930; Craig, U.S. Pat. No. 4,705,326; Lakso, U.S. Pat. No. 4,711,505; Pham, U.S. Pat. No. 4,955,672; Scheerhorn, U.S. Pat. No. 5,056,876; Mitchell, U.S. Pat. No. 5,176,436; McGregor, U.S. Pat. No. 5,333,949; Hartrum et al., U.S. Pat. No. 5,335,986; and Hubbard et al., U.S. Pat. No. 5,586,817. Certain of these systems use a relatively large number of parts. Others require relatively precise alignment of parts, absent which proper function may be impaired or prevented. As noted above, generally, the more complicated is the assembly of such systems, the more expensive becomes manufacturing, ultimately adding to the cost of the product to the end user.

SUMMARY OF THE INVENTION

In one form of the invention, a drawer system is provided having a frame, first and second drawers that are each slidable guidingly on the frame between open and closed positions, and a locking mechanism. The locking mechanism has a first blocking element mounted for movement relative to the frame between a blocking position and a neutral position and a second blocking element mounted for movement relative to the frame between a blocking position and a neutral position. A first actuating surface is provided on the first drawer, with a second actuating surface being provided on the second drawer. The first blocking element in its blocking position prevents the second blocking element from moving from its neutral position into its blocking position. The second blocking element in its blocking position prevents the first blocking element from moving from its neutral position into its blocking position. The first actuating surface moves the first blocking element from its neutral position into its blocking position as an incident of the first drawer moving from its closed position into its open position. The second actuating surface moves the second blocking element from its neutral position into its blocking position as an incident of the second drawer moving from its closed position into its open position.

The first and second blocking elements may each be pivotable about an axis in moving between the neutral and blocking positions.

In one form, the first and second drawers each have a front and rear and laterally spaced sides. Each of the first and second drawers moves from front to rear in moving between its open position and its closed position. The first and second blocking elements are pivotable about first and second axes in moving between the neutral and blocking positions, with the first and second axes projecting laterally with respect to the first and second drawers.

In one form, the first blocking element has one piece that is abuttable directly to the first actuating surface and abuttable directly to the second blocking element with the first blocking element in its blocking position. The second blocking element in its neutral position prevents movement of the second drawer from its closed position into its open position.

The locking mechanism may have at least one bias element for normally urging the first and second blocking elements towards their neutral positions.

The at least one bias element may have one piece, such as a wire, that connects directly between the first and second blocking elements.

A first actuator plate may be attached to the first drawer and defines the first actuating surface.

The first actuator plate may have a third actuating surface which engages and moves the first blocking element from its blocking position towards its neutral position as an incident of the first drawer moving from its open position into its closed position.

The locking mechanism may further have a second actuator plate attached to the second drawer. The second actuator plate defines the second actuating surface. The second actuator plate has a fourth actuating surface which engages and moves the second blocking element from its blocking position towards its neutral position as an incident of the second drawer moving from the open position for the second drawer into the closed position for the second drawer.

The first actuator plate may have a fifth actuating surface which allows the first actuator plate to be mounted on the second drawer so that the first actuating surface moves the second blocking element from its neutral position into its blocking position as an incident of the second drawer moving from its closed position into its open position. The fifth actuating surface engages the second blocking element and moves the second blocking element from its blocking position towards its neutral position as an incident of the second drawer moving from its open position into its closed position.

In one form, the first actuating surface is defined by a first actuator plate on the first drawer and at least one of the first actuator plate and first blocking element is repositionable to allow the first drawer to move from its open position into its closed position with the first blocking element in its neutral position.

The first actuator plate may have a ramp surface which engages and repositions the first blocking element to allow the first actuating surface to move to and past the first blocking element as the first drawer moves between its open and closed positions with the first blocking element in its neutral position.

In one form, the first drawer has a front and rear and laterally spaced sides, with the first drawer moving from front to rear in moving between its open and closed positions. The ramp surface deflects the first blocking element laterally relative to the first drawer as the first drawer moves from its open position into its closed position with the first blocking element in its neutral position.

In one form, the first blocking element is bendable such that the ramp surface deflects the first blocking element laterally by bending the first blocking element.

In one form, the locking mechanism is a first locking mechanism and the drawer system further has a third drawer that is slidable guidingly on the frame between an open position and a closed position, and a fourth drawer that is slidable guidingly relative to the frame between an open position and a closed position. A second locking mechanism has the same configuration as the first locking mechanism on the frame and is operatively connected between the third and fourth drawers in the same manner that the first locking mechanism is operatively connected between the first and second drawers.

In one form, the first and second locking mechanisms are completely independent, each from the other.

The blocking elements may be mounted in a housing so as to define a self-contained module that can be attached to the frame.

The frame may have a wall with a flat surface which is directly exposed to both the first and second drawers, with the self-contained module being attached to the flat surface without being recessed into the flat surface.

In one form, there is a translatable loading element/follower on the housing which is biased to urge at least one of the blocking elements into at least one of the blocking and neutral positions for the at least one of the blocking elements.

In one form, there is a translatable loading element/follower on the housing which is biased to urge at least one of the blocking elements into both the blocking and neutral positions for the at least one of the blocking elements.

In one form, there is a translatable loading element/follower on the housing which is biased to urge each of the blocking elements into both the blocking and neutral positions for each of the blocking elements.

In one form, there is a movable loading element/follower on the housing which is biased to urge at least one of the blocking elements into both the blocking and neutral positions for the at least one of the blocking elements.

In one form, the loading element/follower has first and second surfaces which are angled with respect to each other. The first and second surfaces may move as one piece as the loading element/follower translates. The first surface may engage the first blocking element with the second surface engaging the second blocking element.

In one form, the loading element/follower is movable between first and second positions and with the loading element/follower in the second position the loading element/follower projects from the housing further than with the loading element/follower in the first position.

In one form, the first drawer is above the second drawer, with the first and second drawers having a top and bottom, and the locking mechanism does not project to above the top of the first drawer or below the bottom of the second drawer.

The invention further contemplates a locking mechanism module, for mounting on a piece of furniture having a frame and a plurality of drawers that can be moved relative to the frame to be selectively opened and closed, to control opening of the drawers. The locking mechanism module has a housing and first and second blocking elements each mounted for movement relative to the housing between blocking and neutral positions. The first and second blocking elements project in cantilever fashion oppositely from the housing. The first and second blocking elements cooperate such that a) with the first blocking element in its blocking position the first blocking element prevents the second blocking element from moving from its neutral position into its blocking position, and b) with the second blocking element in its blocking position, the second blocking element prevents the first blocking element from moving from its neutral position into its blocking position. The locking mechanism module can be mounted upon a piece of furniture having a plurality of drawers such that with a first and second of the drawers closed, a) opening of the first drawer causes an actuating surface on the first drawer to engage and move the first blocking element from its neutral position into its blocking position, and b) opening of the second drawer causes an actuating surface on the second drawer to engage and move the second blocking element from its neutral position into its blocking position.

The first and second blocking elements may be directly engageable, each with the other.

The first and second blocking elements may each have one piece that directly engages the other of the first and second blocking elements, with each one piece projecting from the housing to be engageable by an actuating surface on one of the first and second drawers.

The invention further contemplates a combination of a) a piece of furniture having a frame and first and second drawers that can be slidably moved relative to the frame between opened and closed positions with there being a first actuating surface on the first drawer and a second actuating surface on the second drawer and b) a first locking mechanism module mounted on the frame and having a first housing, a first blocking element mounted for movement relative to the first housing between a blocking position and a neutral position, and a second blocking element mounted for movement relative to the first housing between a blocking position and a neutral position. The first and second blocking elements project in cantilever fashion oppositely from the first housing. The first and second blocking elements cooperate such that a) with the first blocking element in the blocking position for the first blocking element, the first blocking element prevents the second blocking element from moving from the neutral position for the second blocking element into the blocking position for the second blocking element and b) with the second blocking element in the blocking position for the second blocking element the second blocking element prevents the first blocking element from moving from the neutral position for the first blocking element into the blocking position for the first blocking element. With the first and second drawers closed, opening of the first drawer causes the actuating surface on the first drawer to engage and move the first blocking element from the neutral position for the first blocking element towards the blocking position for the first blocking element. Opening of the second drawer causes an actuating surface in the second drawer to engage and move the second blocking element from the neutral position for the second blocking towards the blocking position for the second blocking element.

The piece of furniture may have third and fourth drawers that can be slidably moved between open and closed position, with there being a third actuating surface on the third drawer and a fourth actuating surface on the fourth drawer. The combination may further include c) a second locking mechanism module mounted on the frame and having a second housing, a third blocking element mounted for movement relative to the second housing between a blocking position and a neutral position, and a fourth blocking element mounted for movement relative to the second housing between a blocking position and a neutral position. Third and fourth blocking elements project oppositely from the second housing. The third and fourth blocking elements cooperate such that a) with the third element in the blocking position for the third blocking element the third blocking element prevents the fourth blocking element from moving from the neutral position for the fourth blocking element into the blocking position for the fourth blocking element and b) with the fourth blocking element in the blocking position for the fourth blocking element the fourth blocking element prevents the third blocking element from moving from the neutral position for the third blocking element into the blocking position for the third blocking element. With the third and fourth drawers closed, opening of the third drawer causes the third actuating surface on the third drawer to engage and move the third blocking element from the neutral position for the third blocking element towards the blocking position for the third blocking element. Opening of the fourth drawer causes the fourth actuating surface on the fourth drawer to engage and move the fourth blocking element in the neutral position for the fourth blocking element towards the blocking position for the fourth blocking element.

The combination may further include an interconnecting linkage which operatively connects between the first and second locking mechanism modules. The interconnecting linkage has a slider which is movable between first and second blocking positions. The slider is in the first blocking position as an incident of either one of the first and blocking elements moving from the neutral position for the either one of the first and second blocking elements to the blocking position for the either one of the first and second blocking elements, as a result of which the interconnecting linkage prevents the third and fourth blocking elements from moving from the neutral position for the third and fourth blocking elements into the blocking position for the third and fourth blocking element. The slider is in the second blocking position as an incident of either one of the third and fourth blocking elements moving from the neutral position for the either one of the third and fourth blocking elements to the blocking position for the either one of the third and fourth blocking elements, as a result of which the interconnecting linkage prevents the first and third blocking elements from moving from the neutral position for the first and second blocking elements into the blocking position for the first and second blocking elements.

The interconnecting linkage may have a first interconnecting element that is pivotably connected to the first locking mechanism module and the slider and a second interconnecting element that is pivotably connected to the second locking mechanism module and the slider.

In one form, the first interconnecting element is pivotable relative to the first housing between a blocking position and a second position and the second interconnecting element is pivotable relative to the second housing between a blocking position and a second position. The first blocking mechanism module has a first loading element/follower that has an end that is movable relative to the first housing between a flush position and a projecting position as an incident of either of the first and second blocking elements moving from the neutral position for the either of the first and second blocking elements into the blocking position for the either of the first second blocking elements. The second blocking mechanism module has a second loading element/follower with an end that is movable relative to the second housing between a flush position and a blocking position as an incident of either of the third and fourth blocking elements moving from the neutral position for the either of the third and fourth blocking elements into the blocking position for the either of third and fourth blocking elements. With the slider in the first blocking position for the slider, the slider maintains the second interconnecting element in the blocking position for the second interconnecting element and the first loading element/follower prevents the first interconnecting element from moving from the second position for the first interconnecting element into the blocking position for the first interconnecting element. With the slider in the second blocking position for the slider, the slider maintains the first interconnecting element in the blocking position for the first interconnecting element and the second loading element/follower prevents the second interconnecting element from moving from the second position for the second interconnecting element into the blocking position for the second interconnecting element.

In one form, the first loading element/follower repositions the first interconnecting element from the blocking position for the first interconnecting element into the second position for the first interconnecting element as an incident of the end of the first loading element/follower moving from the flush position for the end of the first loading element/follower into the projecting position for the end of the first loading element/follower.

The slider may be translatable between the first and second blocking positions for the slider.

BRIEF DESCRIPTION OF THE DRAWINGS

FIG. 7 is an enlarged, side elevation view of the inventive locking mechanism in a state wherein one of two drawers with which the locking mechanism is associated is in an open position;

FIG. 8 is an enlarged, front elevation view of the inventive locking mechanism showing the locking mechanism resetting itself;

FIG. 9 is an enlarged, plan view of a module forming part of the inventive locking mechanism;

FIG. 10 is a partially schematic, perspective view of a piece of furniture with four slidable drawers thereon and with three locking mechanisms, according to the present invention, incorporated therein;

FIG. 11 is a schematic representation of the three locking mechanisms in FIG. 10 modified so that the locking mechanisms are interconnected with each other;

DETAILED DESCRIPTION OF THE DRAWINGS

Figure 1:
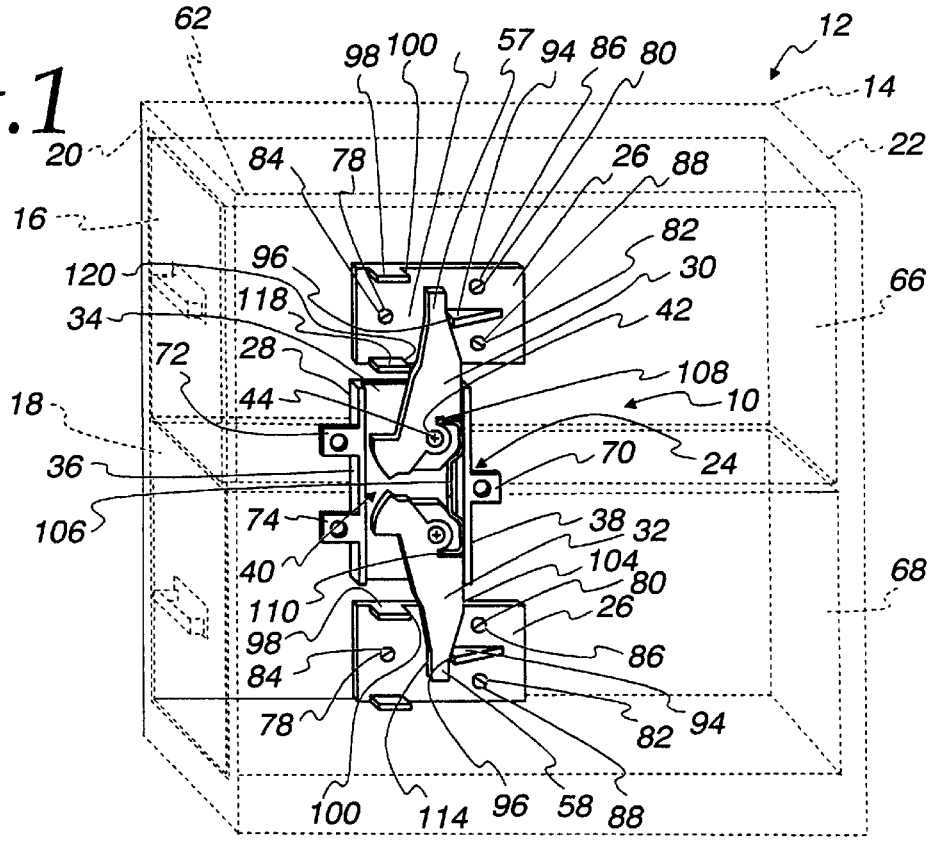
FIG. 1 is a perspective view of a piece of furniture with two drawers thereon and with a locking mechanism, according to the present invention, incorporated therein.
Figure 2:
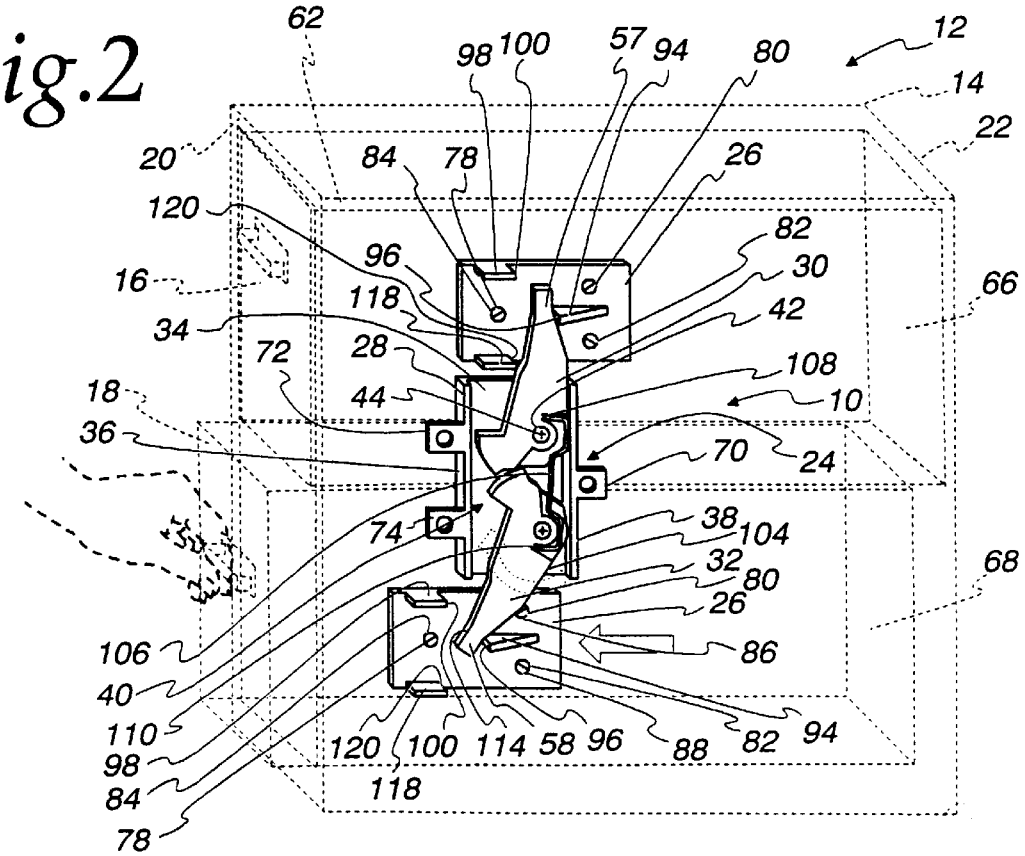
FIG. 2 is a view as in FIG. 1 with the lower of the two drawers being moved towards an open position therefor.

In FIGS. 1–9, one form of locking mechanism, according to the present invention, is shown at 10. The locking mechanism 10 is shown operatively connected to a piece of furniture 12 having a frame 14 upon which upper and lower, first and second drawers 16, 18 are each conventionally mounted guidingly for sliding movement between open and closed positions. Both drawers 16, 18 are slidable between the front 20 of the cabinet and the rear 22 of the cabinet in moving between their open and closed positions. Both drawers 16, 18 are shown in the closed position in FIG. 1, with the drawer 18 partially open in FIG. 3 and the drawer 16 partially open in FIG. 5.

The locking mechanism 10 consists of a module 24, which is attachable to the frame 14, and actuator plates 26 attachable, one each, to the drawers 16, 18. The module 24 consists of a U-shaped housing 28 to which generally L-shaped first and second blocking elements 30, 32 are operatively mounted. The housing 28 has a base portion 34 and spaced legs 36, 38 projecting from the base portion 34 so that the base portion 34 and legs 36, 38 cooperatively bound a space 40 within which a substantial portion of each of the blocking elements 30, 32 resides.

Figure 5:
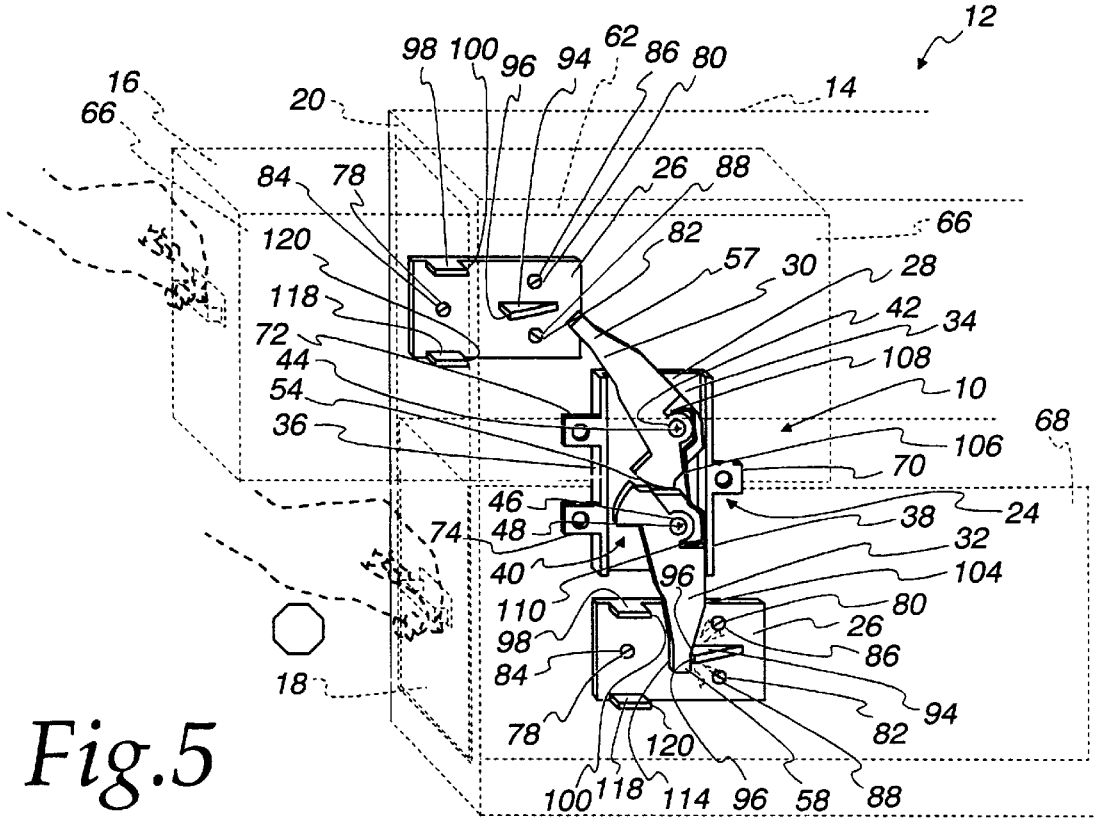
FIG. 5 is a view as in FIG. 4 with the upper of the two drawers being moved further towards the open position therefor.
Figure 6:
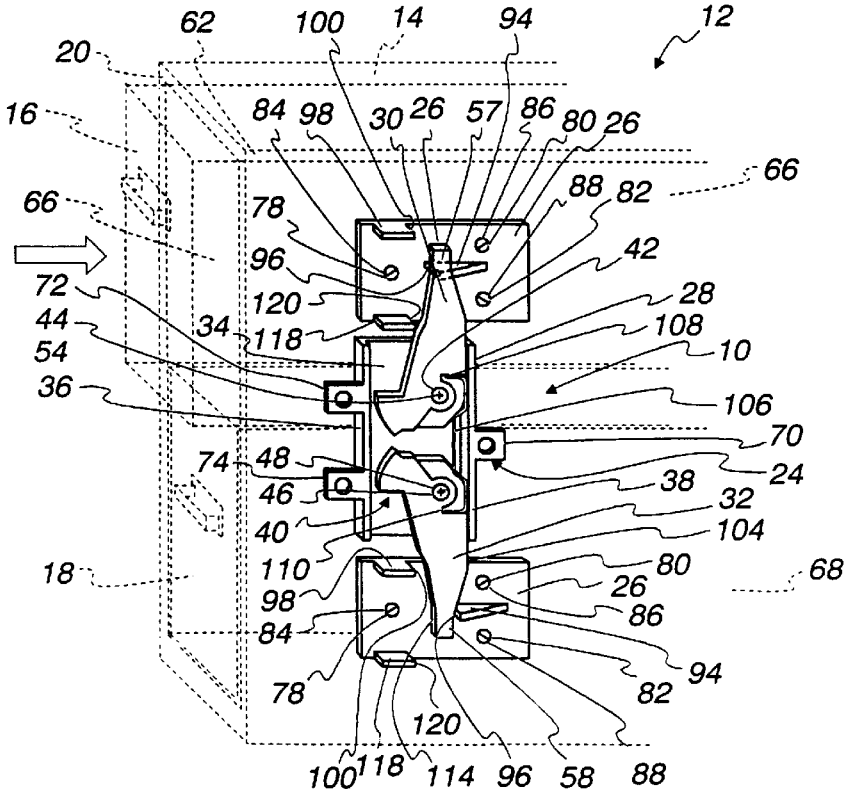
FIG. 6 is a view as in FIG. 5 with the upper of the two drawers being moved back towards the closed position therefor.

The blocking element 30 is connected to the base portion 34 of the housing 28 by a pin 42 for pivoting movement about a laterally extending axis 44 relative to the housing 28. The blocking element 32 is similarly mounted to the base portion 34 of the housing 28 by a pin 46 for pivoting movement relative to the housing 28 about a laterally extending axis 48 that is substantially parallel to the axis 44. The blocking element 30 is pivotable between a neutral position, as shown in FIGS. 1, 2, 3, 6, and 7, and a blocking position, as shown in FIG. 5. The blocking element 32 is likewise pivotable between a neutral position, as shown in FIGS. 1 and 4–6, and a blocking position, as shown in FIG. 7. As seen in FIG. 7, with the blocking element 32 in the blocking position, an edge 50 on the blocking element 32 is situated to confront an edge 52 on the blocking element 30 to prevent the blocking element 30 from pivoting in a counterclockwise direction from the neutral position into the blocking position therefor. Similarly, as seen in FIG. 5, with the blocking element 30 in the blocking position, an edge 54 thereon confronts an edge 56 on the blocking element 32 to prevent the blocking element 32 from pivoting clockwise from the neutral position into the blocking position.

The blocking elements 30, 32 have portions 57, 58 which project in cantilever fashion oppositely from the housing 28 to cooperate with the actuator plates 26 on the upper drawer 16 and lower drawer 18, respectively. The actuator plates 26 are mounted to the drawers 16, 18 so that opening and closing of the drawers 16, 18 repositions the blocking elements 30, 32 between the blocking and neutral positions therefor.

More specifically, the module 24 is mounted to a surface 60 (FIGS. 8 and 9) of the frame side wall 62. The surface 60 faces laterally inwardly towards and is directly exposed to the drawers 16, 18. The drawer 16 has a surface 66 facing laterally towards and adjacent to the side wall surface 60, with the drawer 18 having a like surface 68 facing towards and adjacent to the side wall surface 60.

The module 24 can be made with a relatively thin profile so that it can be attached to the frame surface 60 without forming any recess therein. To facilitate mounting, cantilevered tabs 70, 72, 74 are formed as one piece with the housing 28 and are pre-bored to accept screws 76 (FIG. 9), which are extended therethrough and into the frame 14. The frame side wall 62 can be pre-drilled to accommodate the screws 76. With the arrangement of three tabs 70, 72, 74 shown, the module 24 can be assembled in only one manner on the frame 14. The module 24 is located between the drawers 16, 18 so that the blocking element portions 57, 58 reside within the path of the actuator plates 26 mounted to the drawers 16, 18, respectively.

Each of the actuator plates 26 is likewise provided with an arrangement of three mounting bores 78, 80, 82 to accept a like number of screws 84, 86, 88 which extend therethrough and into the drawers 16, 18. The drawers 16, 18 can be pre-drilled to facilitate mounting of the actuator plates 26. Again, the three-hole arrangement permits only one, proper mounting of the actuator plates on the drawers 16, 18.

Figure 3:
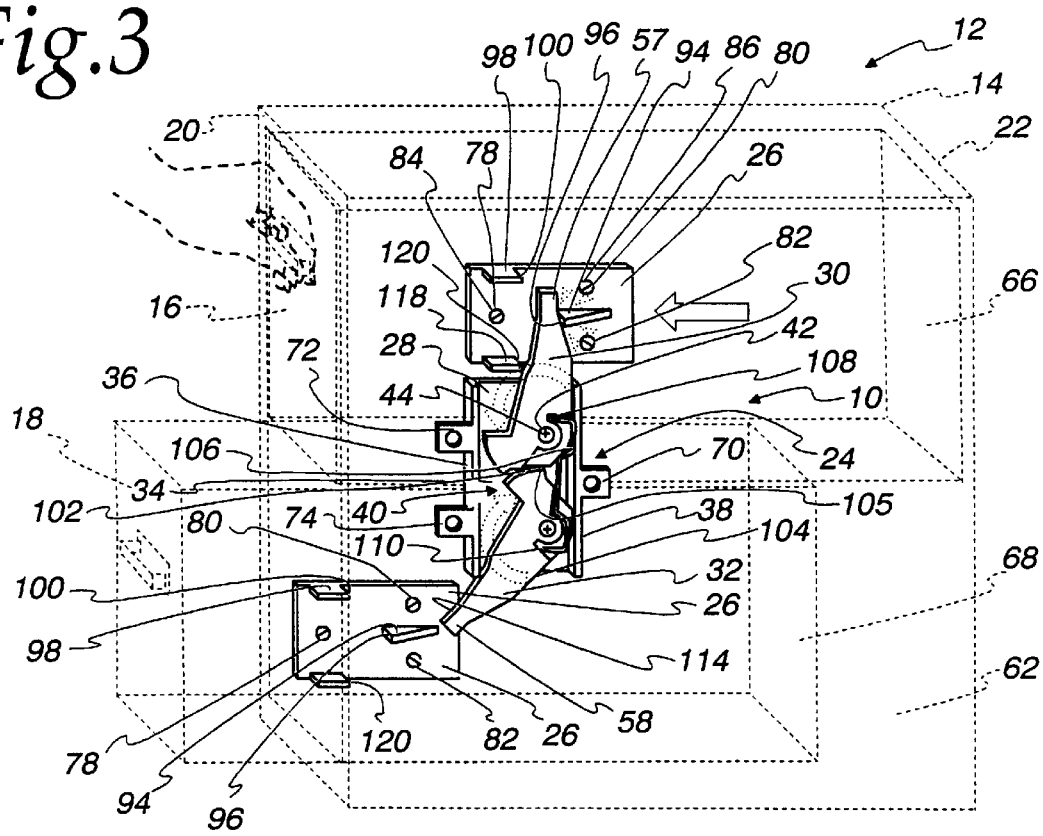
FIG. 3 is a view as in FIG. 2 with the lower of the two drawers being moved further towards the open position therefor.
Figure 4:
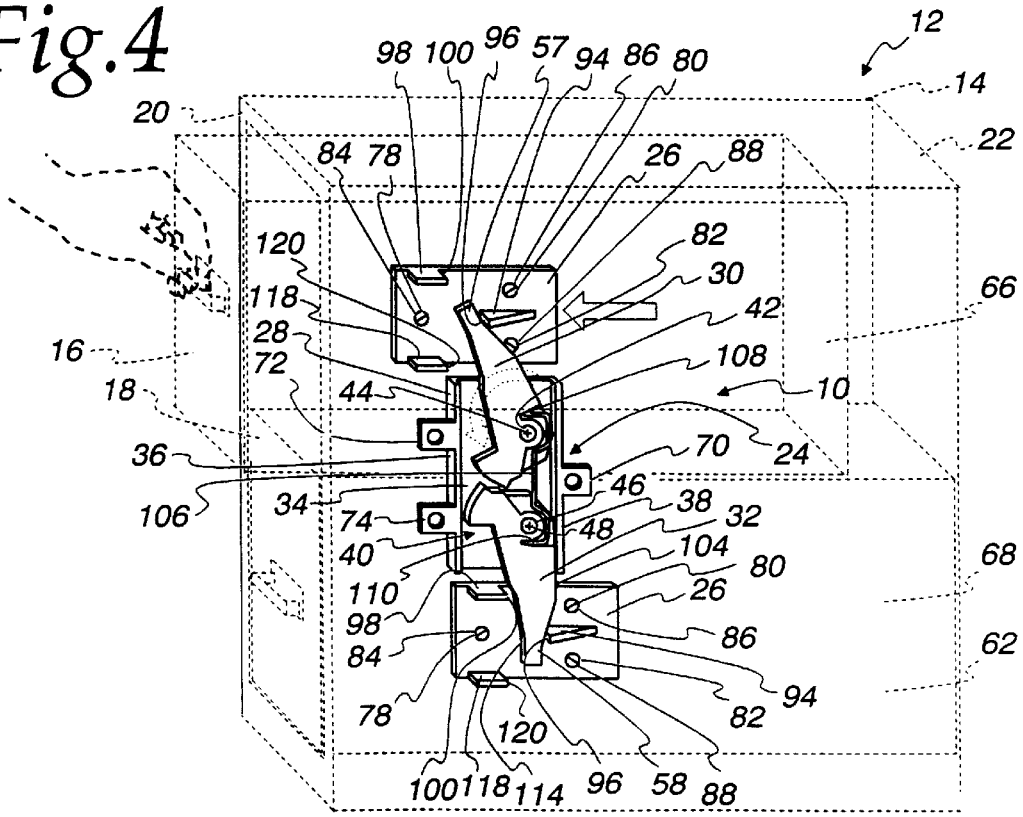
FIG. 4 is a view as in FIGS. 1–3 with the upper of the two drawers being moved towards an open position therefor.

The cooperation between the actuator plate 26 and the blocking element 32 will first be described. The actuator plate 26 has a boss 94 defining a forwardly facing actuating surface 96. A separate boss 98 defines a rearwardly facing actuating surface 100. With both drawers 16, 18 in the closed position, the drawer 18 can be moved from the closed position into the open position therefor. As this occurs, the actuating surface 96 engages a rearwardly facing edge 104 on the blocking element 32 and progressively cams the blocking element 32 from the neutral position into the blocking position therefor. As seen in FIG. 3, as the blocking element 32 realizes the blocking position, an edge 102 thereon abuts to an edge 105 on the blocking element 30 to limit clockwise pivoting of the blocking element 32 relative to the housing 28.

In a preferred form, the actuator plate 26 does not remain in contact with the blocking element 32 as the blocking element 32 realizes the blocking position therefor. Instead, an over-center spring 106, mounted directly between the blocking elements 30, 32, draws the blocking element 32 towards each of the neutral and blocking positions therefor. This allows the blocking element 32 to clear away from the boss 94 so that there is no interference between the boss 94 and the blocking element 32 as the drawer 18 is re-closed with the blocking element 32 in the blocking position.

In a preferred form, the spring 106 has a one-piece construction with a generally "M" shape. The spring is pre-loaded so that the spring ends 108, 110, which are secured to the blocking elements 30, 32, are biasably urged towards each other. This produces the over-center action and allows a single wire element to produce the over-center action on both the blocking elements 30, 32.

As the drawer 18 is moved from the open position to the closed position therefor, the surface 100 engages a forwardly facing edge 114 on the blocking element 32 and urges the blocking element 32 back into the neutral position therefor as the drawer 18 is closed. The edge 104 abuts to the leg 38 on the housing 28 to limit counterclockwise pivoting of the blocking element 32 with the blocking element 32 in its neutral position.

The actuator plates 26 each have a boss 118 with an actuating surface 120. The additional boss 118 allows the actuator plate 26 to have a universal construction. That is, with the actuator plate 26 mounted to the upper drawer 16, the actuating surface 120 cooperates with the blocking element 30 in the same manner that the actuating surface 100 cooperates with the blocking element 32 with the actuator plate 26 mounted to the drawer 18.

With the above construction, with both drawers 16, 18 in their closed position, both blocking elements 30, 32 are in their neutral position. Opening of either drawer 16, 18 causes the blocking element 30, 32 associated therewith to move from the neutral position to the blocking position, as a consequence of which the other blocking element 30, 32 is prevented from moving out of its neutral position.

Another feature of the present invention allows each of the drawers 16, 18 to be assembled and moved from its open position into its closed position with the associated blocking element 30, 32 in the neutral position therefor. This feature is shown in FIGS. 7 and 8. The boss 94 is provided with a ramp edge 124. As the upper drawer 16 moves towards the closed position, the trailing portion 126 initially contacts the laterally inwardly facing surface 130 of the blocking edge portion 56. Continued rearward movement of the actuator plate 26 progressively cams the portion 56 laterally outwardly. As the drawer 16 realizes the closed position, the blocking element portion 56 clears the boss 94, whereupon the blocking element portion 56 springs back to its initial undeformed state. The lateral deflection of the blocking element portion 56 is permitted by making the blocking element 30 of a relatively flexible bendable material, such as plastic, which has sufficient memory that it is not permanently deformed by reason of the aforementioned deflection.

In FIG. 10, another furniture piece is shown at 136 and has a frame 138 and four vertically stacked drawers 140, 142, 144, 146. In this case, three modules 24 are mounted to the frame 138 between adjacent drawers 140, 142, 144, 146. The modules 24 can be mounted independently of each other so that it is possible to open a maximum of two of the drawers, i.e., the top and bottom drawers 140, 146, at the same time.

Alternatively, as shown in FIG. 11, an interconnecting means 150 can be incorporated such that as any one of the drawers 140, 142, 144, 146 is opened, the modules 24 associated with the other drawers 140, 142, 144, 146 are appropriately actuated to prevent opening thereof. For example, by opening the drawer 146, the drawer 144 is prohibited from opening by reason of the module 24 therebetween. Through the interconnecting structure, the modules 24 between the drawers 144, 142 and 142, 140 can be similarly operated to prevent opening of the drawers 140, 142.

While there are many ways of assembling the inventive locking mechanism 10, the locking mechanism 10, as described above, permits the modules 24 to be constructed so that they can be surface mounted to the furniture frames 14, 138. The modules 24 and actuator plates 26 can be constructed so that the relative positions of the module 24 and actuator plates 26 may vary significantly without interfering with the system operation.

In FIGS. 12–16, a modified form of module, according to the present invention, is shown at 200. The module 200 can be substituted for the module 24, as shown in FIGS. 1–11, and cooperates with all other parts identified in those Figures in the same fashion.

The module 200 consists of a housing 202 that has an overall rectangular shape. The housing 202 has a T-shaped undercut region 204 which defines a receptacle for pivoting blocking elements 206, 208 and a translatable, spring-biased loading element/follower 210.

Figure 13:
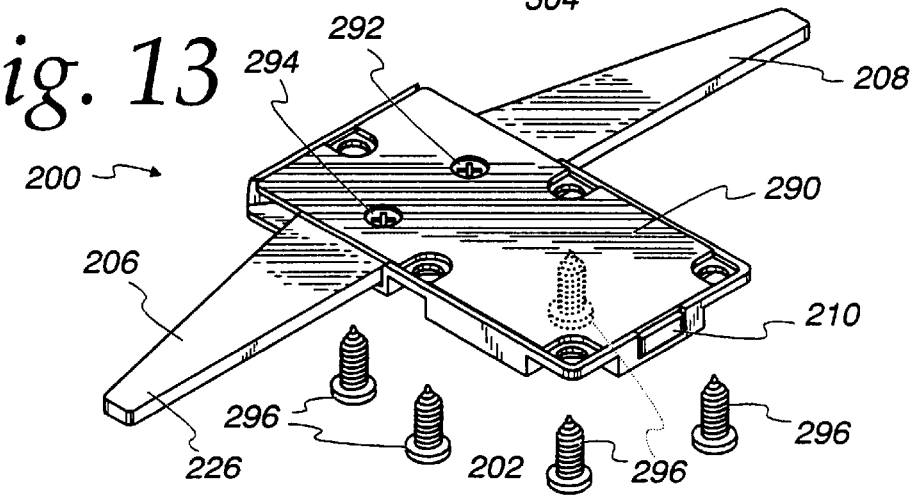
FIG. 13 is a perspective view of the assembled module in FIG. 12.
Figure 14:
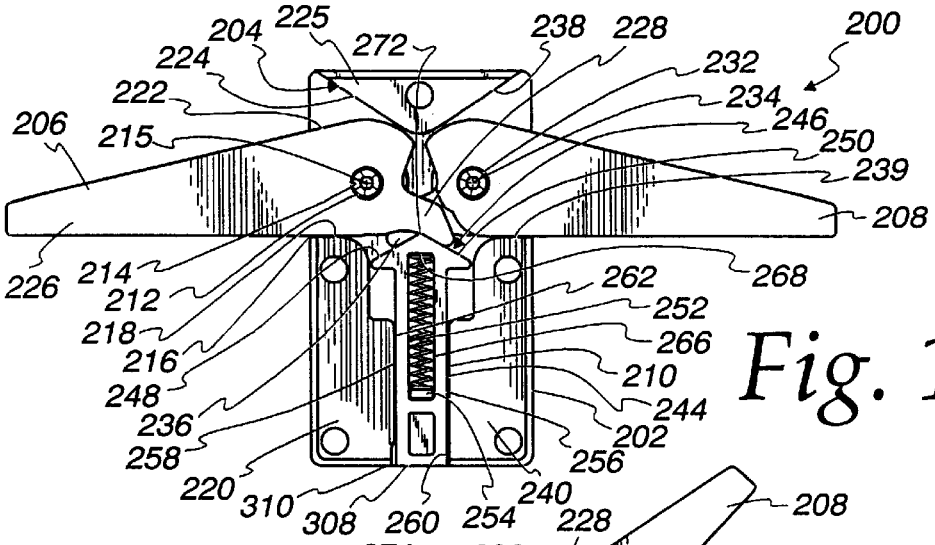
FIG. 14 is a side elevation view of the module in FIGS. 12 and 13 with two blocking elements thereon in a neutral position.
Figure 15:
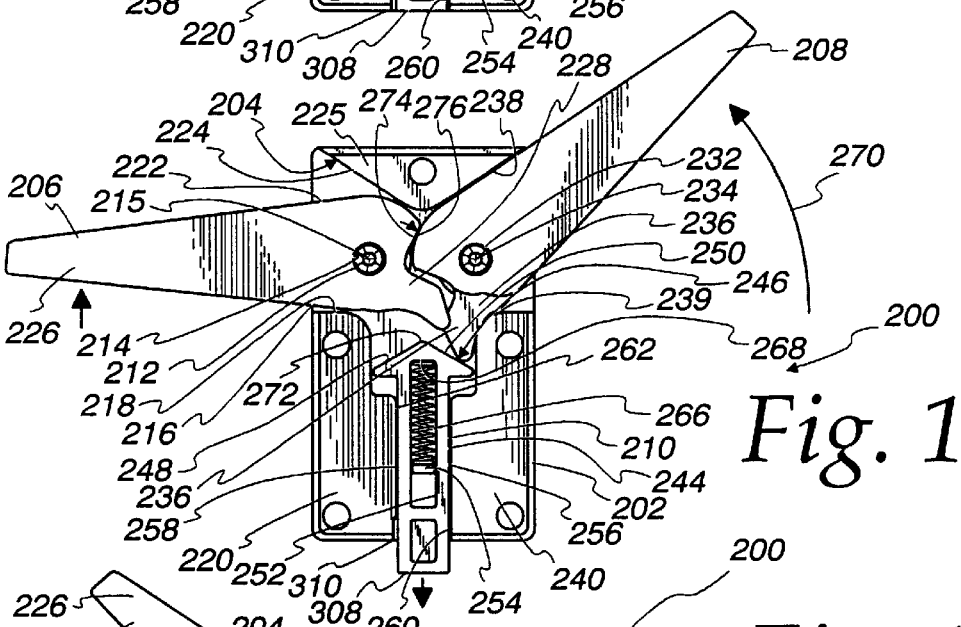
FIG. 15 is a view as in FIG. 14 with one of the blocking elements in a neutral position and the other blocking element in a blocking position.
Figure 16:
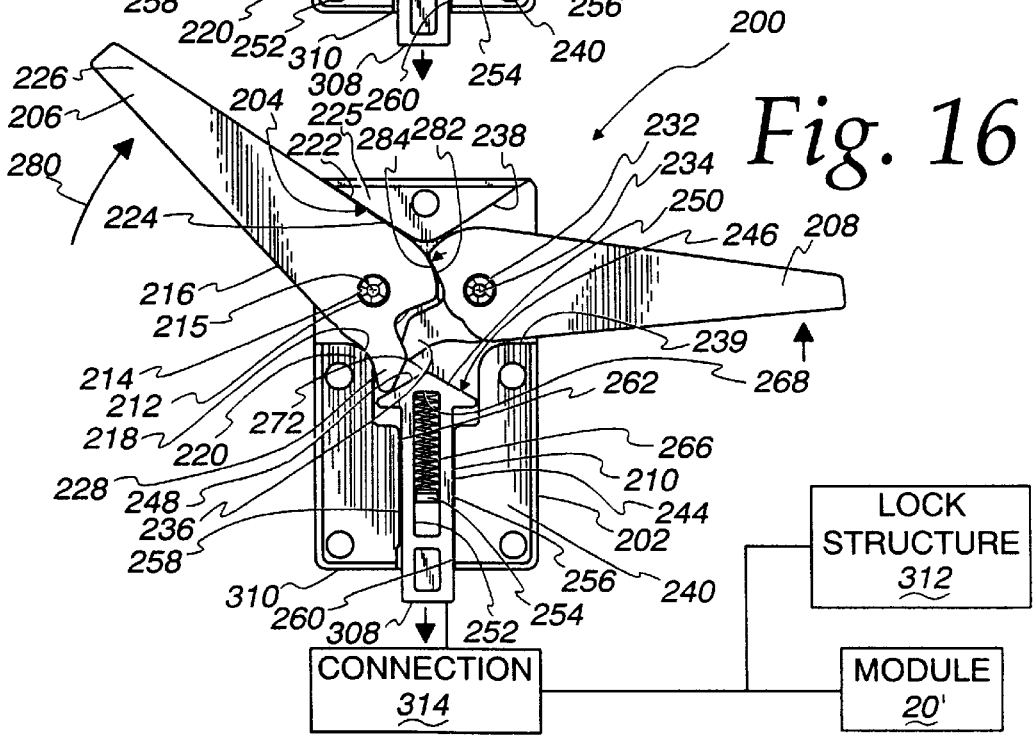
FIG. 16 is a view as in FIG. 15 with the blocking element in FIG. 15 that is in the neutral position in the blocking position and the blocking element that is in the blocking position in the neutral position.
Figure 17:
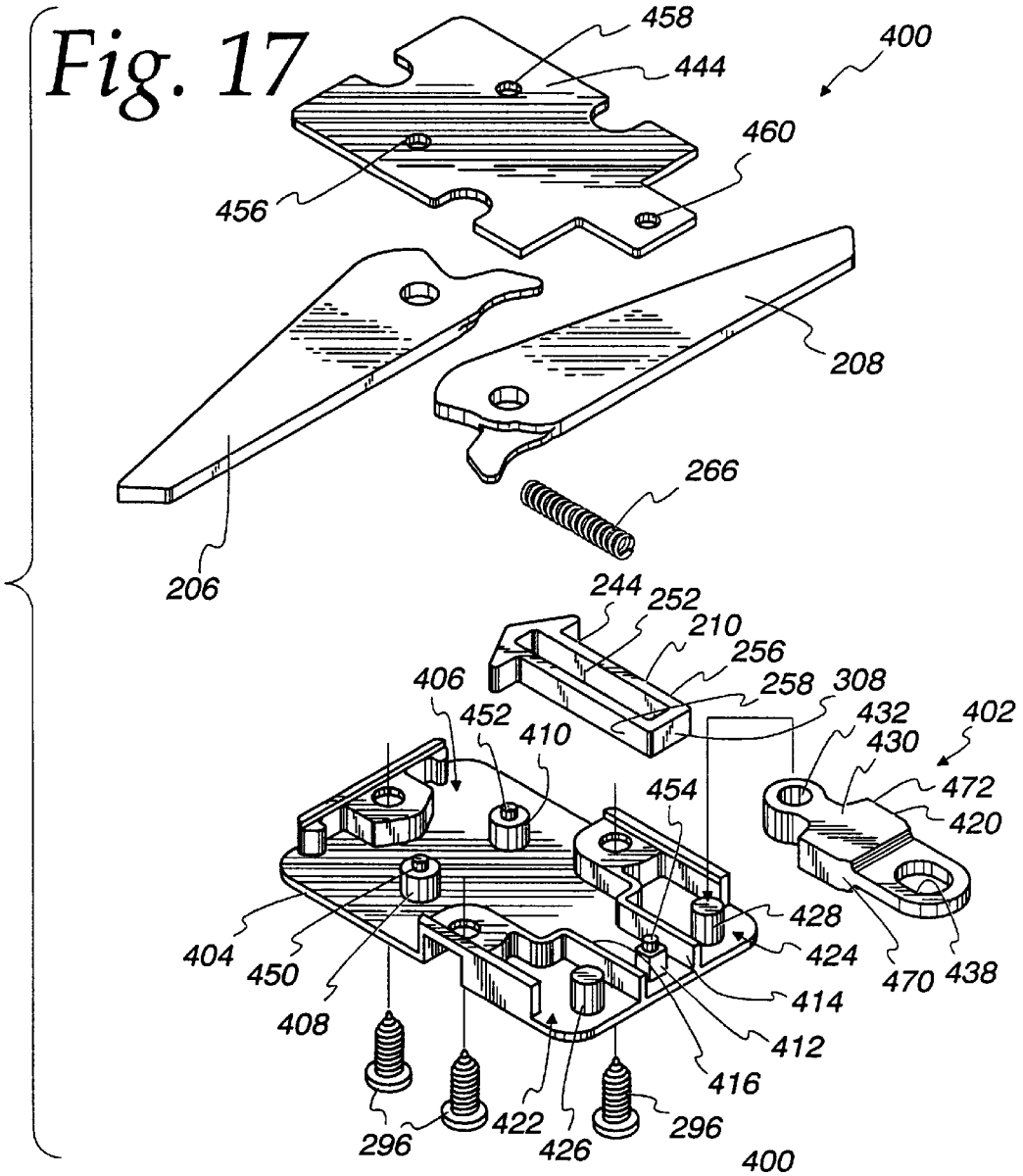
FIG. 17 is an exploded, perspective view of a further modified form of a module forming part of the inventive locking mechanism with an element that is part of an interconnecting linkage which allows one module to effect the operation of another module.

The housing 202 has a post 212 which projects into a bore 214 through the blocking element 206 to guide pivoting movement of the blocking element around an axis 215 between a neutral position, as shown in FIGS. 13–15, and a blocking position, as shown in FIG. 16.

In the neutral position, an edge portion 216 on the blocking element 206 abuts to a shoulder 218 defined by a boss 220 on the housing 202 to limit pivoting movement of the blocking element 206 in a counterclockwise direction in FIGS. 12–16 around the axis 215 beyond the neutral position shown. A separate edge portion 222 on the blocking element 206 abuts to an edge 224 defined by another boss 225 on the housing 202 with the blocking element 206 pivoted from the neutral position to the blocking position.

Figure 12:
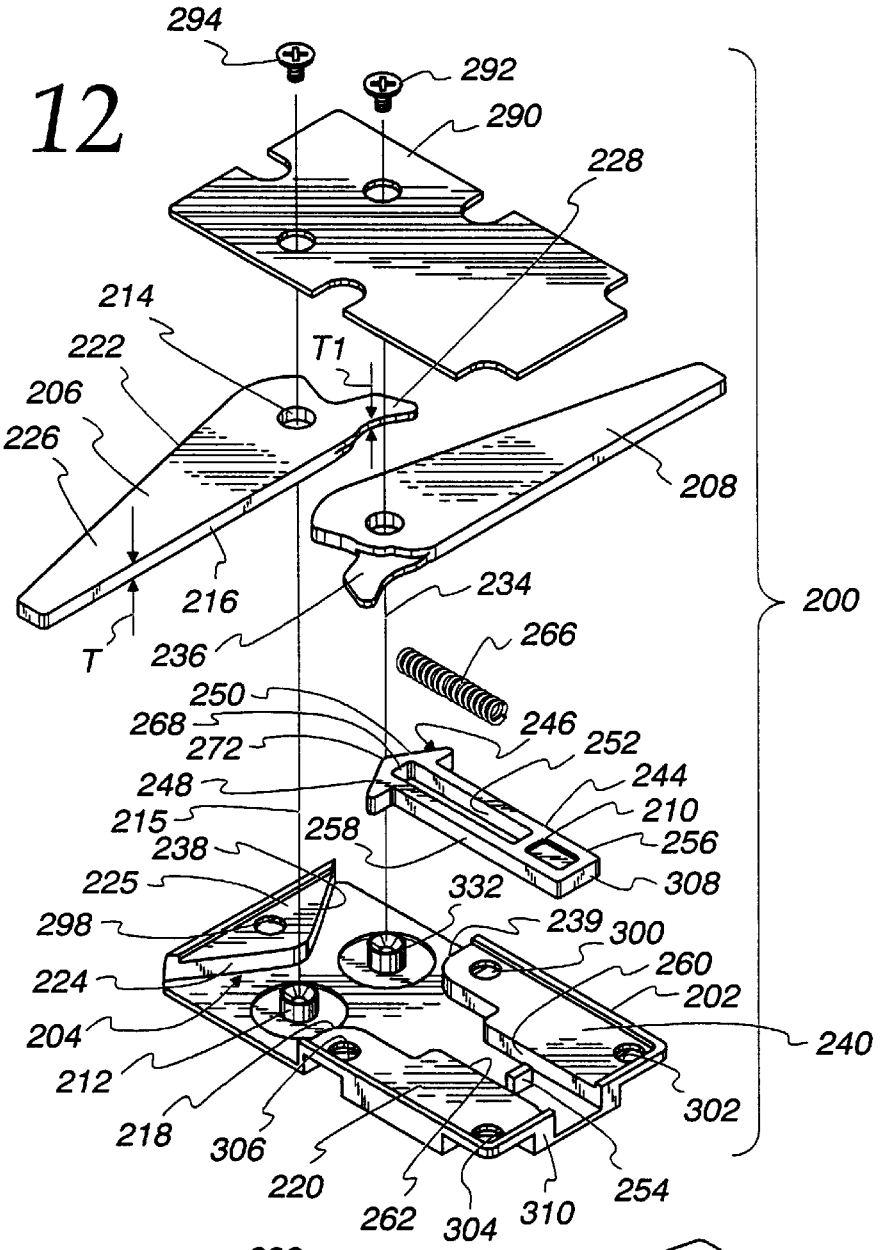
FIG. 12 is an exploded, perspective view of a modified form of a module forming part of the inventive locking mechanism.

The blocking element 206 has a main body 226 with a thickness T (FIG. 12). A cantilevered arm 228 projects from the main body 226 and has a thickness T1 (FIG. 12) on the order of one-half the thickness T. The arm 228 abuts to the boss 220 on the housing 202 simultaneously as the edge portion 222 abuts to the edge 224 to positively arrest pivoting movement of the blocking element 206 as it realizes the blocking position of FIG. 16.

The blocking element 208 is pivotably mounted to a post 232 for pivoting movement about an axis 234 defined by the post 232 between a neutral position, as shown in FIGS. 13, 14 and 16, and a blocking position, as shown in FIG. 15.

The blocking elements 206, 208 are preferably of identical construction and "flip-flopped" so that an arm 236 on the blocking element 208 can move into overlying relationship with the arm 228 on the blocking element 206 as the blocking elements 206, 208 relatively move between the neutral and blocking positions therefor.

Movement of the blocking element 208 beyond the neutral and blocking positions therefor is prevented by an edge 238 on the boss 225, corresponding to the edge 224, and a shoulder 239 on a boss 240, corresponding to the boss 220.

The loading element/follower 210 has an elongate, rectangular body 244 with a V-shaped head surface 246 defined by a first surface portion 248 and a second surface portion 250, which are at an angle of approximately 120° with respect to each other. The body 244 has an elongate slot 252 formed therethrough to receive a post 254 projecting from the housing 202 into the undercut region 204. The loading element/follower 210 is guided in translational movement between a first position, as shown in FIG. 14, wherein the surface portions 248, 250 act on the arms 236, 238 to urge the blocking elements 208, 206 into the neutral position therefor, and a second position, shown in FIGS. 15 and 16, which results from either of the blocking elements 206, 208 moving into the blocking position, as described in greater detail below. The loading element/follower 210 is guided in translation between the first and second positions simultaneously by the post 254 in the slot 252 and by oppositely facing surfaces 256, 258 on the body 244 which act, one each, slidingly against facing surfaces 260, 262 on the housing 202.

A coil spring 266 is loaded between the post 254 and a facing surface 268 bounding the slot 252 to urge the loading element/follower 210 toward the first position therefor. The operation of the module 200 is as follows.

With both drawers 16, 18 closed, the surface portion 248 on the loading element/follower 210 acts against the arm 236 and the surface portion 250 acts against the arm 238 to normally bias the blocking elements 206, 208 to the neutral position of FIG. 14. As the drawer 16 is opened from its closed position, the actuator plate 26 thereon pivots the blocking element 208 from the neutral position of FIG. 14 to the blocking position of FIG. 15, as indicated by the arrow 270 (FIG. 15). As this occurs, the arm 236 acts first against the surface portion 248, progressively urging the loading element/follower 210 from its first position towards its second position. Continued pivoting of the blocking element 208 causes the arm 236 to ride past the surface portion 248, over an apex 272 between the surface portions 248, 250, and onto the surface portion 250, whereupon the blocking element 208 assumes an over center relationship with the loading element/follower 210, as an incident of which the spring 266 moves the loading element/follower 210 towards the first position, thereby causing the surface portion 250 to drive the blocking element 208 fully into the blocking position therefor.

In the blocking position, an edge 274 (FIG. 15) on the blocking element 208 is situated to confront an edge 276 on the blocking element 206 to thereby prevent the blocking element 206 from moving from the neutral position of FIGS. 14 and 15 into the blocking position of FIG. 16 as would otherwise result from opening of the drawer 18.

With the module 200 in the FIG. 14 state, opening of the drawer 18 causes the actuator plate 26 on the drawer 18 to pivot the blocking element 206 from the neutral position of FIGS. 14 and 15 to the blocking position of FIG. 16, as indicated by the arrow 280 (FIG. 16). As this occurs, an edge 282 (FIG. 16) on the blocking element 206 confronts an edge 284 on the blocking element 208 to prevent the blocking element 208 from moving from the neutral position into the blocking position therefor. As this movement of the blocking element 206 occurs, the arm 228 moves the loading element/follower 210 towards the second position, and as this occurs is guided over the surface portion 250, beyond the apex 272, into an overcenter position against the surface 248, which drives the blocking element 206, under the force of the spring 266, fully into the blocking position.

As the drawers 16, 18 are closed, the actuator plates 26 thereon move the blocking elements 206, 208 from the blocking position into the neutral position therefor, allowing the loading element/follower 210 to move under the force of the spring 266 back into its first position.

The blocking elements 206, 208 and loading element/follower 210 are maintained captively in an operative position against the housing 202 by a cover plate 290. The cover plate 290 is held in place by screws 292, 294, which project into the posts 232, 212, respectively.

The housing 202 is in turn held in place by screws 296 which extend through bores 298, 300, 302, 304, 306 (FIG. 12) and into the appropriate mounting surface. The bores 298–306 are nonsymmetrically arranged. By pre-drilling the bores in the support surface to match the non-symmetrical arrangement of bores 298–306, the module 200 can only be mounted in its correct operative position.

As the loading element/follower 210 moves between its first position and its second position, an end 308 remote from the head surface 246 moves from a position in FIGS. 13 and 14, wherein it is substantially flush with an edge 310 on the housing 202, into a position in FIGS. 15 and 16 wherein it projects from the housing 202. Movement of the end 308 from the flush position to the projecting position results from either of the blocking elements 206, 208 changing from the neutral position to the blocking position therefor.

The end of the body element/follower 210 is available to be used to effect operation of another module 20' (FIG. 16) or lock structure 312 through an appropriate connection 314. For example, the module 20 can be associated with a first pair of drawers 140, 142, as shown in FIG. 10, with the module 20' associated with a second pair of drawers 144, 146, in that same Figure. By opening either drawer 140, 142, the module 20' can be re-configured so that only one of the two drawers 144, 146 associated therewith can be opened simultaneously with one of the drawers 140, 142. Alternatively, the locking structure 312 can be constructed to separately block opening of both of the drawers 144, 146.

In FIGS. 17–23, a further modified form of module, according to the present invention, is shown at 400. The module 400 can be substituted for the modules 24, 200, and likewise cooperates with all of the other parts identified in FIGS. 1–18 in the same fashion. Through a linkage 402, the modules 400 are operatively interconnected so that the repositioning of a drawer relative to one of the modules 400 effects direct operation of that module and operation of at least one module 400, remote therefrom, as described hereinbelow. Before the interconnecting linkage 402 is described, the basic module construction will be described with respect to FIGS. 17–21. To the extent that the module 400 incorporates the same parts shown in the module 200 in FIGS. 12–16, the same reference numerals will be used therefor.

The module 400 has a housing 404 with an overall rectangular shape. The housing 404 has a T-shaped undercut region 406 which defines a receptacle for the pivoting blocking elements 206, 208 and the translatable, spring-biased loading element/follower 210. The blocking elements 206, 208 are pivotably mounted on posts 408, 410 within the receptacle 406 for movement between the blocking and neutral positions, as previously described. The loading element/follower 210 is guided in translation within the receptacle 406 between the first and second positions simultaneously by a post 412 which moves within the slot 252, and by oppositely facing surfaces 414, 416, which act, one each against the facing surfaces 256, 258 on the body 244 of the loading element/follower 210. The coil spring 266 acts between the post 412 and the loading element/follower 210 to urge the loading element/follower 210 normally towards the first position therefor.

The blocking elements 206, 208 and loading element/follower 210 cooperate on the housing 404 in the same manner as they do on the housing 202. The primary difference between the module 400 and the module 200 is that the module 400 is capable of mounting an interconnecting element 420 that is part of the interconnecting linkage 402. Instead of providing the bosses 220, 240 having the configuration shown on the housing 202, the housing 404 has in their stead receptacles 422, 424 within which cantilevered mounting posts 426, 428 project.

The interconnecting element 420 has a generally rectangular body 430 with a cylindrical receptacle 432 at one end thereof to receive either of the posts 426, 428 so as to be guided in pivoting movement relative thereto around an axis 434, 436 which is parallel to the pivot axes 215, 234 for the blocking elements 206, 208, respectively.

Figure 22:
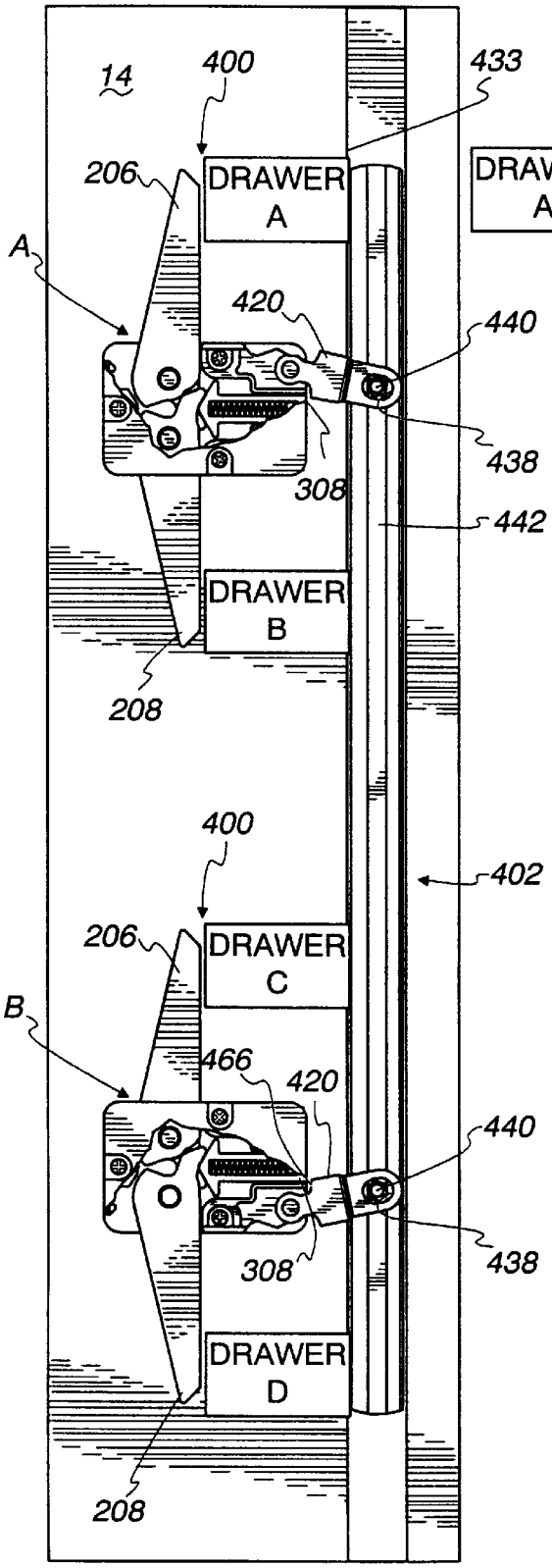
FIG. 22 is a side elevation view of a part of the frame on a piece of furniture which accommodates an upper pair of vertically spaced drawers and a lower pair of vertically spaced drawers with a module as in FIGS. 17–21 associated with each of the upper and lower pairs of drawers, the modules being interconnected through a linkage, and all four drawers shown schematically and in a closed state.
Figure 23:
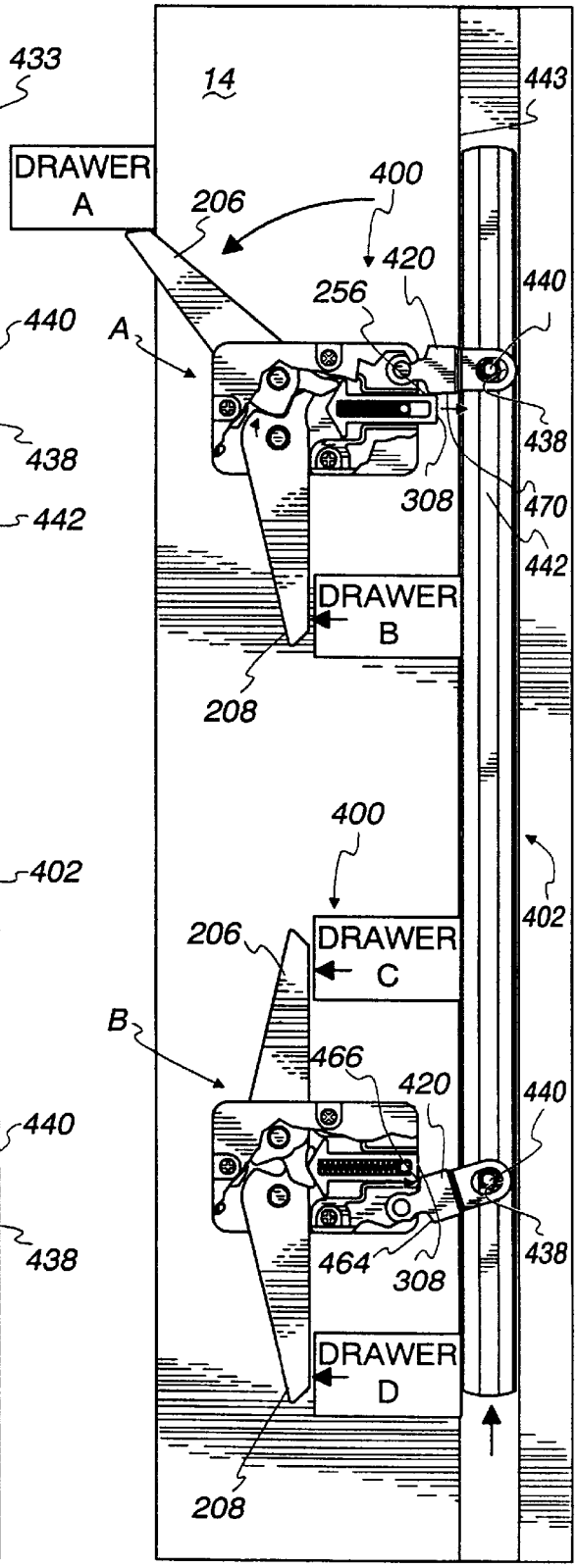
FIG. 23 is a view as in FIG. 22 with the upper drawer in the upper drawer pair opened so as to prevent opening of the other three drawers.
Figure 24:
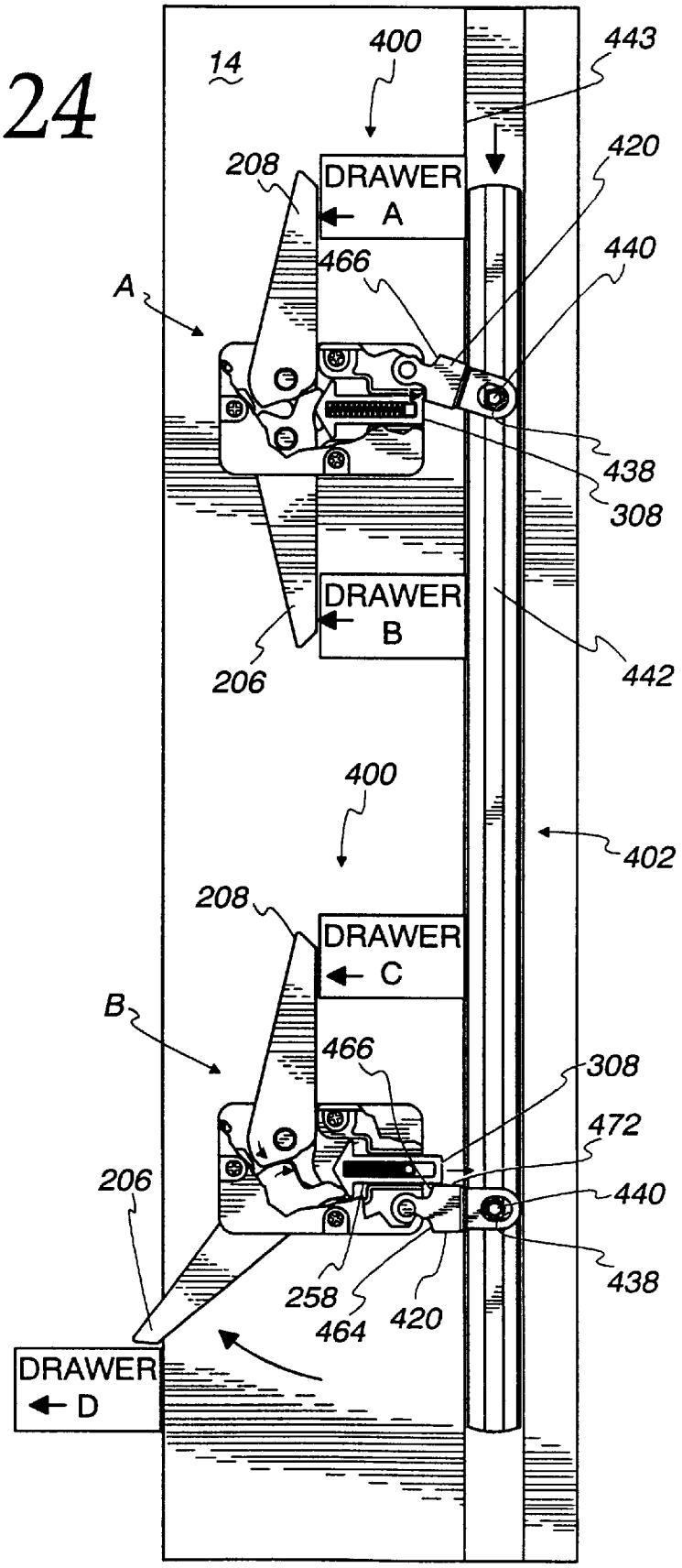
FIG. 24 is a view as in FIGS. 22 and 23 with the lower drawer in the lower drawer pair open to prevent opening of any of the other three drawers.

The end of the body 430, opposite to the end defining the receptacle 432, has an elongate receptacle 438, with a generally oval configuration. The receptacle 438 receives a post 440 projecting in cantilever fashion from a slider 442 on the interconnecting linkage 402, which slider 442 moves guidingly within a slot 443 on the furniture frame 14, as seen in FIGS. 22–24. The slider 442 has posts which reside one each in the receptacle 438 on the interconnecting element 420 associated with each module.

A cover plate 444 is provided over the housing 404 to maintain the blocking elements 206, 208, loading element/follower 210, and interconnecting element 420 in an operative position against the housing 404. The posts 408, 410, 412 have reduced diameter portions 450, 452, 454, respectively, which are frictionally maintained within bores 456, 458, 460 in the cover plate 444.

Figure 18:
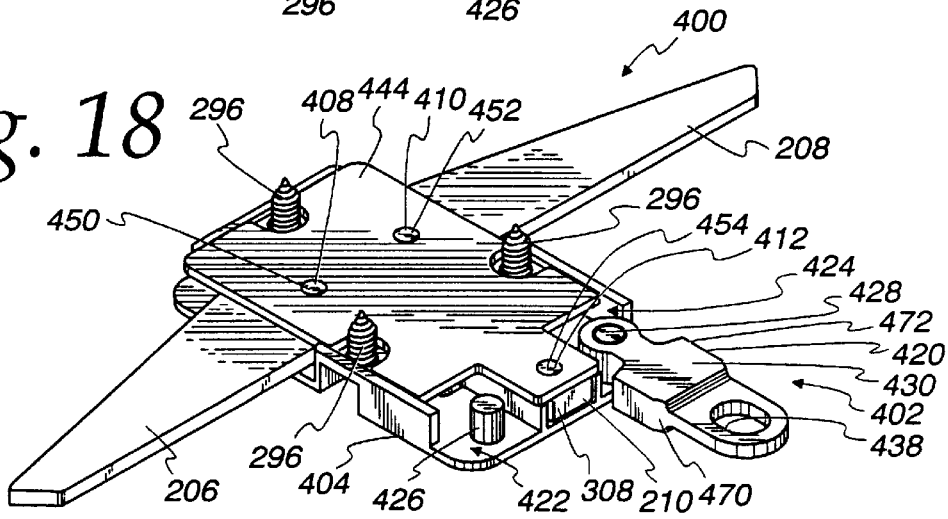
FIG. 18 is a perspective view of the assembled module in FIG. 17.
Figure 19:
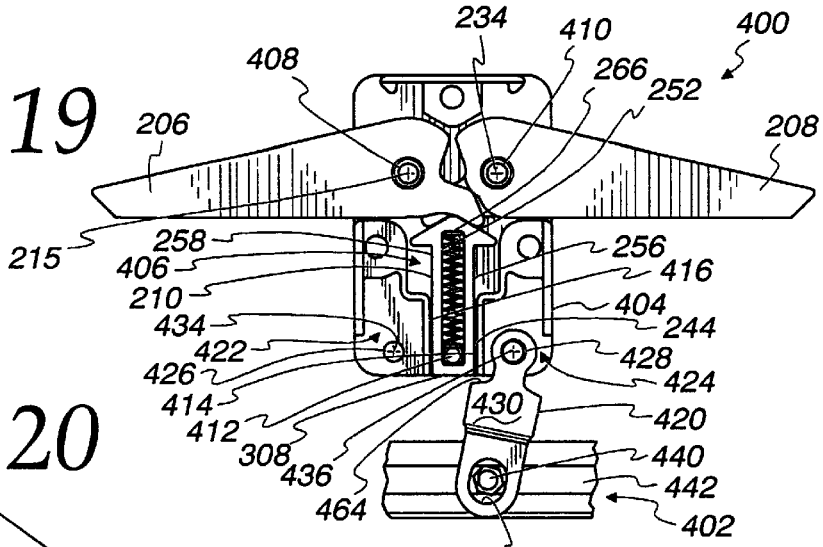
FIG. 19 is a side elevation view of the module in FIGS. 17 and 18 with two blocking elements thereon in a neutral position.
Figure 20:
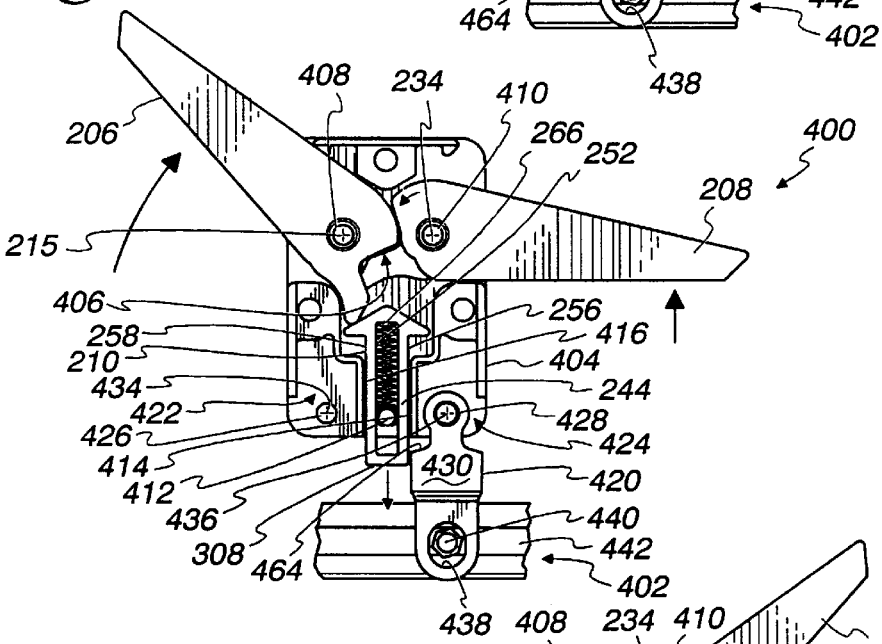
FIG. 20 is a view as in FIG. 19 with one of the blocking elements in a neutral position and the other blocking element in a blocking position.
Figure 21:
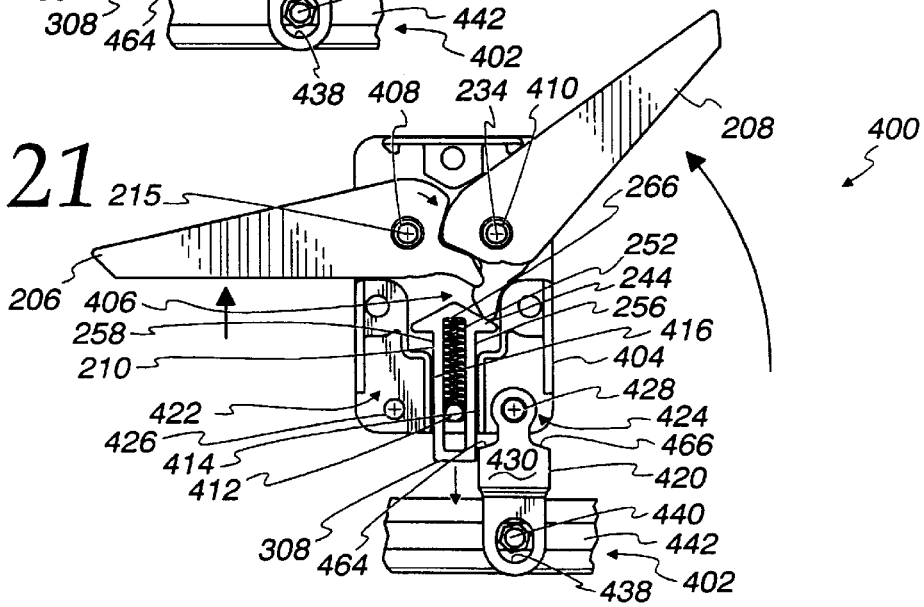
FIG. 21 is a view as in FIG. 20 with the blocking element in FIG. 15 that is in the neutral position in the blocking position and the blocking element that is the blocking position in the neutral position.

As described with respect to the module 200, movement of either blocking element 206, 208 from the neutral position to the blocking position therefor causes the end 308 of the loading element/follower 210 to move from a flush position relative to the housing 404, as shown in FIGS. 18 and 19, to a projecting position as shown in FIGS. 20 and 21.

The operation of the module 400 and interconnecting linkage 402 will now be described. As seen in FIGS. 22–24, one module 400, identified as module A, is mounted to the frame 14 to cooperate with a pair of vertically spaced drawers A and B. A like module 400, identified as module B, is mounted remotely from the module A, in this case therebelow, to cooperate with a pair of vertically spaced drawers C and D. The module A has the interconnecting element 420 pivotably connected to the post 428 in the receptacle 424, whereas on the module B, the interconnecting element 420 is pivotably mounted to the mounting post 426 in the receptacle 422. By making the housing 404 with both receptacles 422, 424, the housing 404 has a universal construction, which allows it to be used in either location shown in FIGS. 22–24.

Referring to FIGS. 19–21, the interconnecting element 420 mounted on the post 428 is repositionable by pivoting movement around the axis 436 between a blocking position, as shown in FIG. 19, wherein a shoulder 464 resides within the path of the end 308 of the loading element/follower 210, moving from the flush position to the projecting, position and a second position, as shown in FIGS. 20 and 21 wherein the interconnecting element 420 does not reside in the path of the end 308 of the loading element/follower 210 as it moves from the flush position to the projecting position therefor.

As seen in FIGS. 22–24, the interconnecting element 420 mounted in the receptacle 422 is pivotable about the post 426 between a blocking position, as shown in FIGS. 22 and 23, wherein a shoulder 466 thereon resides in the path of movement of the end 308 of the loading element/follower 210 moving from the flush position to the blocking position therefor, and a second position, as shown in FIG. 24, wherein the end 308 of the loading element/follower 210 moves from the flush position to the projecting position therefor without interference from the interconnecting element 420.

Referring again to FIGS. 19–21, with the interconnecting element 420 in the blocking position of FIG. 19, movement of the end 308 of the loading element/follower 210 from the flush position therefor towards the projecting position therefor, as is caused by movement of either blocking element 206, 208 from its neutral position to its blocking position, causes the end 308 of the loading element/follower 210 to engage the shoulder 464. As the end 308 continues to project outwardly, it progressively cams the interconnecting element 420 in a counterclockwise direction in FIGS. 19–21 from the blocking position of FIG. 19 to the second position of FIGS. 20 and 21. With the interconnecting element 420 in the second position and the end 308 of the loading element/follower 210 in the projecting position, the surface 256 on the loading element/follower 210 is situated adjacent to an edge 470 of the interconnecting element 420 so as to prevent the interconnecting element 420 from pivoting from the second position in FIGS. 20 and 21 back to the blocking position of FIG. 19.

The shoulder 466 on the interconnecting element 420 cooperates with the loading element/follower 210 on the module B in FIGS. 22–24 in like fashion. That is, as the end 308 of the loading element/follower 210 moves from the flush position of FIGS. 22 and 23 towards the projecting position of FIG. 24, the end 308 of the loading element/follower 210 encounters the shoulder 466 on the interconnecting element 420 and progressively pivots the interconnecting element 420 in a clockwise position in FIGS. 22–24 from the blocking position shown in FIGS. 22 and 23 to the second position shown in FIG. 24. With the interconnecting element 420 in the second position of FIG. 24, and the end 308 of the loading element/follower 210 in the projecting position, the surface 258 on the loading element/follower 210 abuts to an edge 472 on the interconnecting element 420 to prevent the interconnecting element 420 from pivoting on a counterclockwise direction in FIG. 24 from the second position shown therein back to the blocking position in FIGS. 22 and 23.

Movement of the interconnecting elements 420 on either of the modules A, B between the blocking and second positions therefor effects a shifting of the slider 442 due to the interaction between the posts 440 and elongate receptacles 438. The slider 442 has three significant different positions. The slider 442 is in a neutral position, as shown in FIG. 22 wherein the blocking elements 206, 208 on both of the modules A, B are in the neutral positions therefor. Movement of either of the drawers A or B from a closed position to an open position, as shown schematically for the drawer A in FIG. 23, repositions the end 308 of the loading/follower 210 from the flush position to the projecting position, and pivots the interconnecting element 420 from the blocking position of FIGS. 22 and 24 to the second position of FIG. 23. This movement of the interconnecting element 420 causes the slider 442 to shift upwardly to a first blocking position. Movement of slider 442 from the neutral position to the first blocking position causes the post 440, associated with the interconnecting element 420 on the module B, to pivot the interconnecting element 420 associated with the module B into the blocking position of FIG. 23. Any attempt to open either of the drawers C or D with the system in this state causes the loading element/follower 210 on the module B to abut to the shoulder 466 and to exert a force that tends to pivot the interconnecting element 420 in a clockwise direction from the blocking position towards the second position. However, this movement is prevented by the surface 256 on the loading element/follower 210 which abuts to the edge 470 on the interconnecting element 420 on the module A.

Thus, by moving the drawer A from the closed position of FIG. 22 to the open position of FIG. 23, the blocking element 206 on the module A moves from the neutral position to the blocking position therefor and, through the interaction of elements within the module A, causes the blocking element 208 to be prohibited from moving from the neutral position to the blocking position, as a consequence of which drawer B cannot be opened. At the same time, the interconnecting element 420 on the module B is moved into, and maintained in, the blocking position. As a result, the blocking elements 206, 208 on the module B are prohibited from moving from their neutral positions to their blocking positions, i.e. the drawers C, D are prevented from moving from closed positions to open positions therefor.

With all drawers A, B, C, D initially closed, opening of one of the drawers C, D causes the end 308 of the loading element/follower 210 on the module B to change from the flush position of FIGS. 22 and 23 into the projecting position of FIG. 24. The end 308 of the loading element/follower 210 acts against the shoulder 466 to urge the slider 442 downwardly, through a camming action against the interconnecting element 420, into the second position of FIG. 24, wherein the surface 258 on the loading element/follower 210 abuts to the edge 472 to prevent upward movement of the slider 442. This represents a second blocking position for the slider 442. In the second blocking position for the slider 442, the interconnecting element 420 associated with the module A is pivoted into, and maintained in, the blocking position of FIG. 24 in which the interconnecting element 420 blocks attempted movement of either blocking element 206, 208 from its neutral position towards it blocking position, which would reposition the end 308 of the loading element/follower 210 from the flush position to the projecting position.

With the above described arrangement, only one of drawers A, B, C and D can be opened. By opening any of the drawers A, B, C and D, the remainder of the drawers A, B, C and D are prohibited from being opened.

The foregoing disclosure of specific embodiments is intended to be illustrative of the broad concepts comprehended by the invention.

We claim:

1. A drawer system comprising:

a frame;

a first drawer that is slidable guidingly on the frame between an open position and a closed position;

a second drawer that is slidable guidingly on the frame between an open position and a closed position; and a locking mechanism comprising:

a) a first blocking element mounted for movement relative to the frame between a blocking position and a neutral position;

b) a second blocking element mounted for movement relative to the frame between a blocking position and a neutral position;

c) a first actuating surface on the first drawer; and d) a second actuating surface on the second drawer, said first blocking element in the blocking position for the first blocking element preventing the second blocking element from moving from the neutral position for the second blocking element into the blocking position for the second blocking element, said second blocking element in the blocking position for the second blocking element preventing the first blocking element from moving from the neutral position for the first blocking element into the blocking position for the first blocking element, the first actuating surface moving the first blocking element from the neutral position for the first blocking element into the blocking position for the first blocking element as an incident of the first drawer moving from the closed position for the first drawer into the open position for the first drawer, the second actuating surface moving the second blocking element from the neutral position for the second blocking element into the blocking position for the second blocking element as an incident of the second drawer moving from the closed position for the second drawer into the open position for the second drawer, wherein the first and second blocking elements are each pivotable about an axis in moving between the neutral and blocking positions for the first and second blocking elements, wherein the first blocking element is abuttable directly to the second blocking element with the first blocking element in the blocking position for the first blocking element and the second blocking element in the neutral position for the second blocking element.

2. The drawer system according to claim 1 wherein the first and second drawers each have a front and rear and laterally spaced sides, each of the first and second drawers moves from front to rear in moving between the open position and the closed position for the first and second drawers, the first and second blocking elements are pivotable about first and second parallel axes in moving between the neutral and blocking positions for the first and second blocking elements, and the first and second axes project laterally with respect to the first and second drawers.

3. The drawer system according to claim 1 wherein the first blocking element has one piece that is abuttable directly to the first actuating surface and abuttable directly to the second blocking element with the first blocking element in the blocking position for the first blocking element and the second blocking element in the neutral position for the second blocking element to thereby prevent movement of the second drawer from the closed position for the second drawer into the open position for the second drawer.

4. The drawer system according to claim 1 wherein the locking mechanism further comprises at least one bias element for normally urging the first and second blocking elements toward the neutral position for the first and second blocking elements.

5. The drawer system according to claim 4 wherein the at least one bias element has one piece of formed wire that connects directly between the first and second blocking elements.

6. The drawer system according to claim 1 wherein the locking mechanism further comprises a first actuator plate attached to the first drawer and the first actuator plate defines the first actuating surface.

7. The drawer system according to claim 1 wherein the first actuating surface is defined by a first actuator plate on the first drawer, at least one of the first actuator plate and first blocking element is repositionable to allow the first drawer to move from the open position for the first drawer into the closed position for the first drawer with the first blocking element in the neutral position for the first blocking element.

8. The drawer system according to claim 7 wherein the first actuator plate has a ramp surface which engages and repositions the first blocking element to allow the first actuating surface to move to and past the first blocking element on the first drawer as the first drawer moves from the open position for the first drawer into the closed position for the first drawer with the first blocking element in the neutral position for the first blocking element.

9. The drawer system according to claim 8 wherein the first drawer has a front and rear and laterally spaced sides, the first drawer moves from front to rear in moving between the open position for the first drawer and the closed position for the first drawer and the ramp surface deflects the first blocking element laterally relative to the first drawer as the first drawer moves from the open position for the first drawer into the closed position for the first drawer with the first blocking element in the neutral position for the first blocking element.

10. The drawer system according to claim 1 wherein the locking mechanism is a first locking mechanism, and the drawer system further comprises:

a third drawer that is slidable guidingly on the frame between an open position and a closed position;

a fourth drawer that is slidable guidingly on the frame between an open and closed position; and a second locking mechanism having the same configuration as the first locking mechanism on the frame and operatively connectable between the third and fourth drawers in the same manner as the first locking mechanism is operatively connected between the first and second drawers.

11. The drawer system according to claim 10 wherein the first and second locking mechanisms are completely independent, each from the other.

12. The drawer system according to claim 1 wherein the blocking elements are mounted on a housing so as to define a self-contained module that can be attached to the frame.

13. The drawer system according to claim 12 wherein the frame comprises a wall with a flat surface which is directly exposed to both the first and second drawers and the self-contained module is attached to the flat surface without being recessed into the flat surface.

14. The drawer system according to claim 1 wherein the blocking elements are mounted on a housing and there is a translatable loading element/follower on the housing which is biased to urge at least one of the blocking elements into one of the blocking and neutral positions for the at least one of the blocking elements.

15. The drawer system according to claim 1 wherein there is a translatable loading element/follower on the housing which is biased to urge at least one of the blocking elements into both the blocking and neutral positions for the at least one of the blocking elements.

16. The drawer system according to claim 1 wherein there is a translatable loading element/follower on the housing which is biased to urge each of the blocking elements into both the blocking and neutral positions for each of the blocking elements.

17. The drawer system according to claim 1 wherein there is a movable loading element/follower on the housing which is biased to urge at least one of the blocking elements into both the blocking and neutral positions for the at least one of the blocking elements.

18. A drawer system comprising:

a frame;

a first drawer that is slidable guidingly on the frame between an open position and a closed position;

a second drawer that is slidable guidingly on the frame between an open position and a closed position; and a locking mechanism comprising:

a) a first blocking element mounted for movement relative to the frame between a blocking position and a neutral position;

b) a second blocking element mounted for movement relative to the frame between a blocking position and a neutral position;

c) a first actuating surface on the first drawer; and d) a second actuating surface on the second drawer, said first blocking element in the blocking position for the first blocking element preventing the second blocking element from moving from the neutral position for the second blocking element into the blocking position for the second blocking element, said second blocking element in the blocking position for the second blocking element preventing the first blocking element from moving from the neutral position for the first blocking element into the blocking position for the first blocking element, the first actuating surface moving the first blocking element from the neutral position for the first blocking element into the blocking position for the first blocking element as an incident of the first drawer moving from the closed position for the first drawer into the open position for the first drawer, the second actuating surface moving the second blocking element from the neutral position for the second blocking element into the blocking position for the second blocking element as an incident of the second drawer moving from the closed position for the second drawer into the open position for the second drawer, wherein the locking mechanism further comprises a first actuator plate attached to the first drawer and the first actuator plate defines the first actuating surface, wherein the first actuator plate has a third actuating surface which engages and moves the first blocking element from the blocking position for the first blocking element towards the neutral position for the first blocking element as an incident of the first drawer moving from the open position for the first drawer into the closed position for the first drawer.

19. The drawer system according to claim 18 wherein the locking mechanism further comprises a second actuator plate attached to the second drawer, the second actuator plate defines the second actuating surface, the second actuator plate has a fourth actuating surface which engages and moves the second blocking element from the blocking position for the second blocking element towards the neutral position for the second blocking element as an incident of the second drawer moving from the open position for the second drawer into the closed position for the second drawer.

20. The drawer system according to claim 19 where the first actuator plate has a fifth actuating surface which allows the first actuator plate to be mounted on the second drawer so that the fifth actuating surface moves the second blocking element from the neutral position for the second blocking element into the blocking position for the second blocking element as an incident of the second drawer moving from the closed position for the second drawer to the open position for the second drawer and the fifth actuating surface engages the second blocking element and moves the second blocking element from the blocking position for the second blocking element towards the neutral position for the second blocking element as an incident of the second drawer moving from the open position for the second drawer into the closed position for the second drawer.

21. A drawer system comprising:

a frame;

a first drawer that is slidable guidingly on the frame between an open position and a closed position;

a second drawer that is slidable guidingly on the frame between an open position and a closed position; and a locking mechanism comprising:

a) a first blocking element mounted for movement relative to the frame between a blocking position and a neutral position;

b) a second blocking element mounted for movement relative to the frame between a blocking position and a neutral position;

c) a first actuating surface on the first drawer; and d) a second actuating surface on the second drawer, said first blocking element in the blocking position for the first blocking element preventing the second blocking element from moving from the neutral position for the second blocking element into the blocking position for the second blocking element, said second blocking element in the blocking position for the second blocking element preventing the first blocking element from moving from the neutral position for the first blocking element into the blocking position for the first blocking element, the first actuating surface moving the first blocking element from the neutral position for the first blocking element into the blocking position for the first blocking element as an incident of the first drawer moving from the closed position for the first drawer into the open position for the first drawer, the second actuating surface moving the second blocking element from the neutral position for the second blocking element into the blocking position for the second blocking element as an incident of the second drawer moving from the closed position for the second drawer into the open position for the second drawer, wherein the first actuating surface is defined by a first actuator plate on the first drawer, at least one of the first actuator plate and first blocking element is repositionable to allow the first drawer to move from the open position for the first drawer into the closed position for the first drawer with the first blocking element in the neutral position for the first blocking element, wherein the first actuator plate has a ramp surface which engages and repositions the first blocking element to allow the first actuating surface to move to and past the first blocking element on the first drawer as the first drawer moves from the open position for the first drawer into the closed position for the first drawer with the first blocking element in the neutral position for the first blocking element, wherein the first drawer has a front and rear and laterally spaced sides, the first drawer moves from front to rear in moving between the open position for the first drawer and the closed position for the first drawer and the ramp surface deflects the first blocking element laterally relative to the first drawer as the first drawer moves from the open position for the first drawer into the closed position for the first drawer with the first blocking element in the neutral position for the first blocking element, wherein the first blocking element is bendable and the ramp surface deflects the first blocking element laterally by bending the first blocking element.

22. A drawer system comprising:

a frame;

a first drawer that is slidable guidingly on the frame between an open position and a closed position;

a second drawer that is slidable guidingly on the frame between an open position and a closed position; and a locking mechanism comprising:

a) a first blocking element mounted for movement relative to the frame between a blocking position and a neutral position;

b) a second blocking element mounted for movement relative to the frame between a blocking position and a neutral position;

c) a first actuating surface on the first drawer; and d) a second actuating surface on the second drawer, said first blocking element in the blocking position for the first blocking element preventing the second blocking element from moving from the neutral position for the second blocking element into the blocking position for the second blocking element, said second blocking element in the blocking position for the second blocking element preventing the first blocking element from moving from the neutral position for the first blocking element into the blocking position for the first blocking element, the first actuating surface moving the first blocking element from the neutral position for the first blocking element into the blocking position for the first blocking element as an incident of the first drawer moving from the closed position for the first drawer into the open position for the first drawer, the second actuating surface moving the second blocking element from the neutral position for the second blocking element into the blocking position for the second blocking element as an incident of the second drawer moving from the closed position for the second drawer into the open position for the second drawer, wherein there is a translatable loading element/follower on the housing which is biased to urge each of the blocking elements into both the blocking and neutral positions for each of the blocking elements, wherein the loading element/follower has first and second surfaces which are angled with respect to each other, the first and second surfaces move as one piece as the loading element translates, the first surface engages the first blocking element and the second surface engages the second blocking element.

23. A drawer system comprising:

a frame;

a first drawer that is slidable guidingly on the frame between an open position and a closed position;

a second drawer that is slidable guidingly on the frame between an open position and a closed position; and a locking mechanism comprising:

a) a first blocking element mounted for movement relative to the frame between a blocking position and a neutral position;

b) a second blocking element mounted for movement relative to the frame between a blocking position and a neutral position;

c) a first actuating surface on the first drawer; and d) a second actuating surface on the second drawer, said first blocking element in the blocking position for the first blocking element preventing the second blocking element from moving from the neutral position for the second blocking element into the blocking position for the second blocking element, said second blocking element in the blocking position for the second blocking element preventing the first blocking element from moving from the neutral position for the first blocking element into the blocking position for the first blocking element, the first actuating surface moving the first blocking element from the neutral position for the first blocking element into the blocking position for the first blocking element as an incident of the first drawer moving from the closed position for the first drawer into the open position for the first drawer, the second actuating surface moving the second blocking element from the neutral position for the second blocking element into the blocking position for the second blocking element as an incident of the second drawer moving from the closed position for the second drawer into the open position for the second drawer, wherein there is a movable loading element/follower on the housing which is biased to urge at least one of the blocking elements into both the blocking and neutral positions for the at least one of the blocking elements, wherein the loading element/follower is movable between first and second positions, with the loading element/follower in the second position the loading element/follower projects from the housing further than with the loading element/follower in the first position.

24. A drawer system comprising:

a frame;

a first drawer that is slidable guidingly on the frame between an open position and a closed position;

a second drawer that is slidable guidingly on the frame between an open position and a closed position; and a locking mechanism comprising:

a) a first blocking element mounted for movement relative to the frame between a blocking position and a neutral position;

b) a second blocking element mounted for movement relative to the frame between a blocking position and a neutral position;

c) a first actuating surface on the first drawer; and d) a second actuating surface on the second drawer, said first blocking element in the blocking position for the first blocking element preventing the second blocking element from moving from the neutral position for the second blocking element into the blocking position for the second blocking element, said second blocking element in the blocking position for the second blocking element preventing the first blocking element from moving from the neutral position for the first blocking element into the blocking position for the first blocking element, the first actuating surface moving the first blocking element from the neutral position for the first blocking element into the blocking position for the first blocking element as an incident of the first drawer moving from the closed position for the first drawer into the open position for the first drawer, the second actuating surface moving the second blocking element from the neutral position for the second blocking element into the blocking position for the second blocking element as an incident of the second drawer moving from the closed position for the second drawer into the open position for the second drawer, wherein the first drawer is above the second drawer, the first and second drawers each have a top and bottom, and the locking mechanism does not project above the top of the first drawer or below the bottom of the second drawer.

25. A locking mechanism module for mounting on a piece of furniture having a frame and a plurality of drawers that can be moved relative to the frame to be selectively opened and closed, to control opening of the drawers, the locking mechanism module comprising:

a housing;

a first blocking element mounted for movement relative to the housing between a blocking position and a neutral position; and a second blocking element mounted for movement relative to the housing between a blocking position and a neutral position, the first and second blocking elements projecting in cantilever fashion oppositely from the housing, the first and second blocking elements cooperating such that a) with the first blocking element in the blocking position for the first blocking element, the first blocking element prevents the second blocking element from moving from the neutral position for the second blocking element into the blocking position for the second blocking element, and b) with the second blocking element in the blocking position for the second blocking element the second blocking element prevents the first blocking element from moving from the neutral position for the first blocking element into the blocking position for the first blocking element, whereby the locking mechanism module can be mounted upon a piece of furniture having a plurality of drawers such that with a first and second of the drawers closed, a) opening of the first drawer causes an actuating surface on the first drawer to engage and move the first blocking element from the neutral position for the first blocking element towards the blocking position for the first blocking element, and b) opening of the second drawer causes an actuating surface on the second drawer to engage and move the second blocking element from the neutral position for the second blocking element towards the blocking position for the second blocking element.

26. The locking mechanism module according to claim 25 wherein the first and second blocking elements are directly engageable, each with the other.

27. The locking mechanism module according to claim 26 wherein the first and second blocking elements each have one piece that directly engages the other of the first and second blocking elements and each one piece projects from the housing to be engaged by an actuating surface on one of the first and second drawers.

28. The drawer system according to claim 25 wherein there is a translatable loading element/follower on the housing which is biased to urge at least one of the blocking elements into both the blocking and neutral positions for the at least one of the blocking elements.

29. The drawer system according to claim 25 wherein there is a translatable loading element/follower on the housing which is biased to urge each of the blocking elements into both the blocking and neutral positions for each of the blocking elements.

30. The drawer system according to claim 29 wherein the loading element/follower has first and second surfaces which are angled with respect to each other, the first and second surfaces move as one piece as the loading element/follower translates, the first surface engages the first blocking element and the second surface engages the second blocking element.

31. The drawer system according to claim 25 wherein there is a movable loading element/follower on the housing which is biased to urge at least one of the blocking elements into both the blocking and neutral positions for the at least one of the blocking elements.

32. The drawer system according to claim 31 wherein the loading element/follower is movable between first and second positions, with the loading element/follower in the second position the loading element/follower projects from the housing further than with the loading element/follower in the first position.

33. In combination:

a) a piece of furniture having a frame and first and second drawers that can each be slidably moved relative to the frame between open and closed positions, there being a first actuating surface on the first drawer and a second actuating surface on the second drawer; and b) a first locking mechanism module mounted on the frame and comprising:

a first housing;

a first blocking element mounted for movement relative to the first housing between a blocking position and a neutral position; and a second blocking element mounted for movement relative to the first housing between a blocking position and a neutral position, the first and second blocking elements projecting in cantilever fashion oppositely from the first housing, the first and second blocking elements cooperating such that a) with the first blocking element in the blocking position for the first blocking element, the first blocking element prevents the second blocking element from moving from the neutral position for the second blocking element into the blocking position for the second blocking element, and b) with the second blocking element in the blocking position for the second blocking element the second blocking element prevents the first blocking element from moving from the neutral position for the first blocking element into the blocking position for the first blocking element, whereby with the first and second drawers closed, a) opening of the first drawer causes the first actuating surface on the first drawer to engage and move the first blocking element from the neutral position for the first blocking element towards the blocking position for the first blocking element, and b) opening of the second drawer causes the second actuating surface on the second drawer to engage and move the second blocking element from the neutral position for the second blocking element towards the blocking position for the second blocking element.

34. The drawer system according to claim 33 wherein there is a translatable loading element/follower on the first housing which is biased to urge at least one of the blocking elements into both the blocking and neutral positions for the at least one of the blocking elements.

35. The drawer system according to claim 33 wherein there is a translatable loading element/follower on the first housing which is biased to urge each of the blocking elements into both the blocking and neutral positions for each of the blocking elements.

36. The drawer system according to claim 35 wherein the loading element/follower has first and second surfaces which are angled with respect to each other, the first and second surfaces move as one piece as the loading element/follower translates, the first surface engages the first blocking element and the second surface engages the second blocking element.

37. The drawer system according to claim 33 wherein there is a movable loading element/follower on the first housing which is biased to urge at least one of the blocking elements into both the blocking and neutral positions for the at least one of the blocking elements.

38. The drawer system according to claim 37 wherein the loading element/follower is movable between flush and second positions, with the loading element/follower in the second position the loading element/follower projects from the first housing further than with the loading element/follower in the flush position.

39. The combination according to claim 33 wherein the piece of furniture has third and fourth drawers that can be slidably moved between open and closed positions, with there being a third actuating surface on the third drawer and a fourth actuating surface on the fourth drawer, the combination further comprising:

c) a second locking mechanism module mounted on the frame and comprising:

a second housing;

a third blocking element mounted for movement relative to the second housing between a blocking position and a neutral position; and a fourth blocking element mounted for movement relative to the second housing between a blocking position and a neutral position, the third and fourth blocking elements projecting oppositely from the second housing, the third and fourth blocking elements cooperating such that a) with the third blocking element in the blocking position for the third blocking element, the third blocking element prevents the fourth blocking element from moving from the neutral position for the fourth blocking element into the blocking position for the fourth blocking element, and b) with the fourth blocking element in the blocking position for the fourth blocking element the fourth blocking element prevents the third blocking element from moving from the neutral position for the third blocking element into the blocking position for the third blocking element, whereby with the third and fourth drawers closed, a) opening of the third drawer causes the third actuating surface on the third drawer to engage and move the third blocking element from the neutral position for the third blocking element towards the blocking position for the third blocking element, and b) opening of the fourth drawer causes the fourth actuating surface on the fourth drawer to engage and move the fourth blocking element from the neutral position for the fourth blocking element towards the blocking position for the fourth blocking element.

40. The combination according to claim 39 further comprising an interconnecting linkage which operatively connects between the first and second locking mechanism modules, the interconnecting linkage having a slider which is movable between first and second blocking positions, the slider being in the first blocking position as an incident of either one of the first and second blocking elements moving from the neutral position for the either one of the first and second blocking elements to the blocking position for the either one of the first and second blocking elements as a result of which the interconnecting linkage prevents the third and fourth blocking elements from moving from the neutral position for the third and fourth blocking elements into the blocking position for the third and fourth blocking elements, the slider being in the second blocking position as an incident of either one of the third and fourth blocking elements moving from the neutral position for the either one of the third and fourth blocking elements into the blocking position for the either one of third and fourth blocking elements as a result of which the interconnecting linkage prevents the first and third blocking elements from moving from the neutral position for the first and second blocking elements into the blocking position for the first and second blocking elements.

41. The combination according to claim 40 wherein the interconnecting linkage comprises a first interconnecting element that is pivotably connected to the first locking mechanism module and the slider and a second interconnecting element that is pivotably connected to the second locking mechanism module and the slider.

42. The combination according to claim 41 wherein the first interconnecting element is pivotable relative to the first housing between a blocking position and a second position and the second interconnecting element is pivotable relative to the second housing between a blocking position and a second position, the first locking mechanism module has a first loading element/follower with an end that is movable relative to the first housing between a flush position and a projecting position as an incident of either of the first and second blocking elements moving from the neutral position for the either of the first and second blocking elements into the blocking position for the either of the first and second blocking elements, the second locking mechanism module has a second loading element/follower with an end that is movable relative to the second housing between a flush position and a blocking positions, as an incident of either of the third and fourth blocking elements moving from the neutral position for the either of the third and fourth blocking elements into the blocking position for the either of the third and fourth blocking elements, with the slider in the first blocking position for the slider the slider maintains the second interconnecting element in the blocking position for the second interconnecting element and the first loading element/follower prevents the first interconnecting element from moving from the second position for the first interconnecting element into the blocking position for the first interconnecting element, and with the slider in the second blocking position for the slider the slider maintains the first interconnecting element in the blocking position for the first interconnecting element and the second loading element/follower prevents the second interconnecting element from moving from the second position for the second interconnecting element into the blocking position for the second interconnecting element.

43. The combination according to claim 42 wherein the first loading element/follower repositions the first interconnecting element from the blocking position for the first interconnecting element into the second position for the first interconnecting element as an incident of the end of the first loading element/follower moving from the flush position for the end of the first loading element/follower into the projecting position for the end of the first loading element/follower.

44. The combination according to claim 43 wherein the slider is translatable between the first and second locking positions for the slider.

* * * * *